US006806858B2

(12) United States Patent
Kurumisawa et al.

(10) Patent No.: US 6,806,858 B2
(45) Date of Patent: Oct. 19, 2004

(54) ELECTRO-OPTICAL APPARATUS AND METHOD OF DRIVING ELECTRO-OPTICAL MATERIAL, DRIVING CIRCUIT THEREFOR, ELECTRONIC APPARATUS, AND DISPLAY APPARATUS

(75) Inventors: Takashi Kurumisawa, Suwa (JP); Akihiko Ito, Suwa (JP); Sugura Yamazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 294 days.

(21) Appl. No.: 10/212,103

(22) Filed: Aug. 6, 2002

(65) Prior Publication Data

US 2003/0030608 A1 Feb. 13, 2003

(30) Foreign Application Priority Data

Aug. 9, 2001 (JP) ..... 2001-242997

(51) Int. Cl.[7] ..... G09G 3/36
(52) U.S. Cl. ..... 345/94; 345/100
(58) Field of Search ..... 345/76, 85, 87, 345/90, 93, 94, 95, 96, 98, 99, 100, 103, 200, 203, 508, 516, 517; 348/761, 766; 359/55, 61, 102; 349/33

(56) References Cited

U.S. PATENT DOCUMENTS 5,489,919 A * 2/1996 Kuwata et al. ..... 345/100
5,900,857 A * 5/1999 Kuwata et al. ..... 345/100
6,084,563 A 7/2000 Ito et al. ..... 345/100
6,657,610 B1 * 12/2003 Baba ..... 345/100
2002/0005843 A1 * 1/2002 Kurumisawa et al. ..... 345/204

FOREIGN PATENT DOCUMENTS

| | | |
|---|---|---|
| JP | A-5-303079 | 11/1993 |
| JP | A-7-140938 | 6/1995 |
| JP | A 7-281645 | 10/1995 |
| JP | A-9-43570 | 2/1997 |
| JP | A-10-39274 | 2/1998 |
| JP | A-2000-292768 | 10/2000 |
| WO | WO 93/18501 | 9/1993 |

* cited by examiner

*Primary Examiner*—Amare Mengistu
*Assistant Examiner*—Nitin Patel
(74) *Attorney, Agent, or Firm*—Oliff & Berridge, PLC

(57) ABSTRACT

In accordance with the invention, signal electrode voltages are generated based on a plurality of scanning pattern sets. A storage circuit stores a display pattern and scanning patterns belonging to a first scanning pattern set PA in association with selection data Ds. A data control unit inverts display data d based on an inversion control signal CTL to generate converted display data d'. The inversion control signal CTL becomes active in association with each element at which the first scanning pattern set differs from a second scanning pattern set. First to third data registers generate a display pattern based on the converted display data d'.

14 Claims, 19 Drawing Sheets

| | | | | | | | | | | | | | | | | |
|---|---|---|---|---|---|---|---|---|---|---|---|---|---|---|---|---|
| R1 | -1 | -1 | -1 | -1 | -1 | -1 | -1 | -1 | +1 | +1 | +1 | +1 | +1 | +1 | +1 | +1 |
| R2 | -1 | -1 | -1 | -1 | +1 | +1 | +1 | +1 | -1 | -1 | -1 | -1 | +1 | +1 | +1 | +1 |
| R3 | -1 | -1 | +1 | +1 | -1 | -1 | +1 | +1 | -1 | -1 | +1 | +1 | -1 | -1 | +1 | +1 |
| R4 | -1 | +1 | -1 | +1 | -1 | +1 | -1 | +1 | -1 | +1 | -1 | +1 | -1 | +1 | -1 | +1 |
| P1 | +V2 | +V1 | +V1 | VC | +V1 | VC | VC | -V1 | +V1 | VC | VC | -V1 | VC | -V1 | -V1 | -V2 |
| P2 | VC | -V1 | +V1 | VC | +V1 | VC | +V2 | +V1 | -V1 | -V2 | VC | -V1 | VC | -V1 | +V1 | VC |
| P3 | VC | -V1 | -V1 | -V2 | +V1 | VC | VC | -V1 | +V1 | VC | VC | -V1 | +V2 | +V1 | +V1 | VC |
| P4 | VC | +V1 | -V1 | VC | +V1 | +V2 | VC | +V1 | -V1 | VC | -V2 | -V1 | VC | +V1 | -V1 | VC |
| | B | A | A | B | A | B | B | A | A | B | B | A | B | A | A | B |

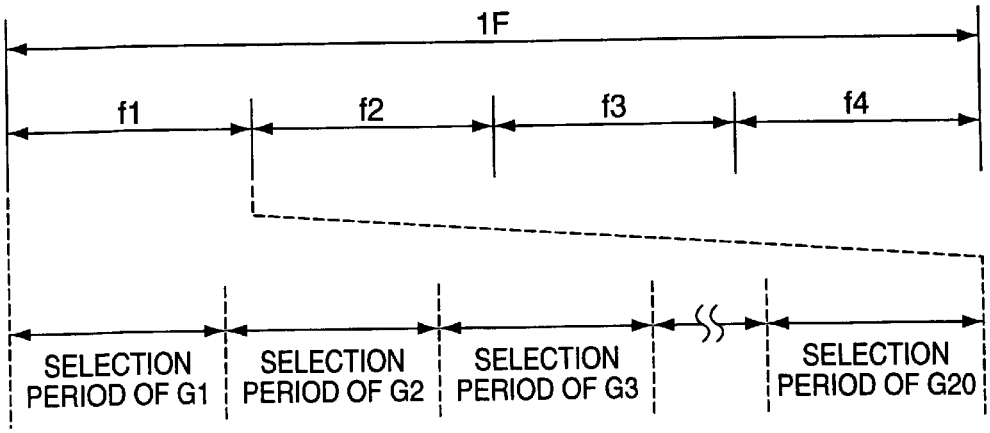
FIG. 2
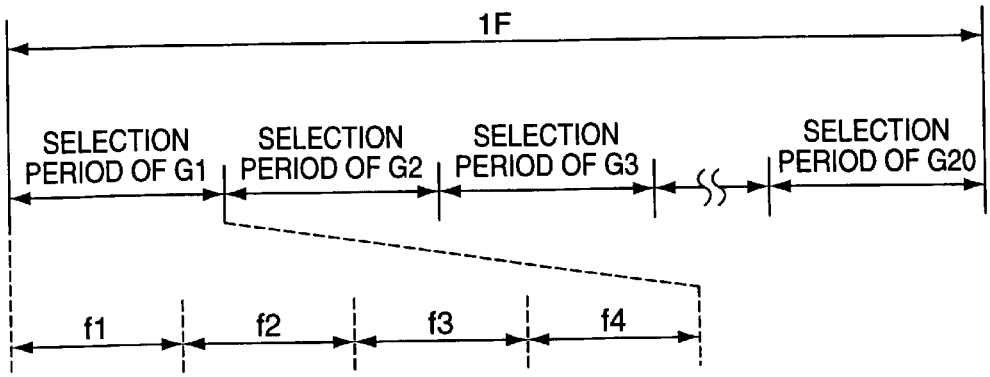
FIG. 3
| P1 | P2 | P3 | P4 | |
|---|---|---|---|---|
| +1 | +1 | −1 | +1 | R1 |
| +1 | −1 | −1 | −1 | R2 |
| +1 | −1 | +1 | +1 | R3 |
| +1 | +1 | +1 | −1 | R4 |
FIG. 4

| | | | | | | | | | | | | | | | |
|---|---|---|---|---|---|---|---|---|---|---|---|---|---|---|---|
| R1 | -1 | -1 | -1 | -1 | -1 | -1 | -1 | -1 | -1 | +1 | +1 | +1 | +1 | +1 | +1 |
| R2 | -1 | -1 | -1 | -1 | -1 | +1 | +1 | -1 | +1 | -1 | -1 | -1 | -1 | +1 | +1 |
| R3 | -1 | -1 | +1 | +1 | -1 | -1 | +1 | +1 | +1 | -1 | -1 | +1 | +1 | +1 | +1 |
| R4 | -1 | +1 | -1 | +1 | -1 | -1 | +1 | -1 | +1 | -1 | +1 | -1 | -1 | -1 | +1 |
| P1 | +V2 | +V1 | +V1 | VC | +V1 | +V1 | VC | VC | -V1 | +V1 | VC | VC | -V1 | -V1 | -V2 |
| P2 | VC | -V1 | +V1 | VC | +V1 | +V1 | VC | +V2 | +V1 | -V1 | -V2 | VC | -V1 | +V1 | VC |
| P3 | VC | -V1 | -V1 | -V2 | +V1 | -V1 | VC | VC | -V1 | +V1 | VC | VC | -V1 | +V1 | VC |
| P4 | VC | +V1 | -V1 | VC | +V1 | +V2 | VC | VC | +V1 | -V1 | VC | -V2 | -V1 | -V1 | VC |
| | B | A | A | B | A | B | B | A | A | A | B | B | A | A | B |

FIG. 5

| FN | 1 | | | | | | | |
|---|---|---|---|---|---|---|---|---|
| fN | ODD NUMBER(1,3,···,19) | | | | EVEN NUMBER(2,4,···,20) | | | |
| PATTERN SET | PA | | | | PB | | | |
| PATTERN | P4 | P1 | P2 | P3 | P3 | P2 | P1 | P4 |
| R1 | +V3 | +V3 | +V3 | −V3 | −V3 | +V3 | +V3 | +V3 |
| R2 | +V3 | −V3 | +V3 | +V3 | −V3 | −V3 | +V3 | −V3 |
| R3 | +V3 | +V3 | −V3 | +V3 | +V3 | −V3 | +V3 | +V3 |
| R4 | −V3 | +V3 | +V3 | +V3 | +V3 | +V3 | +V3 | −V3 |

| FN | 2 | | | | | | | |
|---|---|---|---|---|---|---|---|---|
| fN | ODD NUMBER(1,3,···,19) | | | | EVEN NUMBER(2,4,···,20) | | | |
| PATTERN SET | PA | | | | PB | | | |
| PATTERN | P2 | P3 | P4 | P1 | P1 | P4 | P3 | P2 |
| R1 | +V3 | −V3 | +V3 | +V3 | +V3 | +V3 | −V3 | +V3 |
| R2 | +V3 | +V3 | +V3 | −V3 | +V3 | −V3 | −V3 | −V3 |
| R3 | −V3 | +V3 | +V3 | +V3 | +V3 | +V3 | +V3 | −V3 |
| R4 | +V3 | +V3 | −V3 | +V3 | +V3 | −V3 | +V3 | +V3 |

| FN | 3 | | | | | | | |
|---|---|---|---|---|---|---|---|---|
| fN | ODD NUMBER(1,3,···,19) | | | | EVEN NUMBER(2,4,···,20) | | | |
| PATTERN SET | PB | | | | PA | | | |
| PATTERN | P3 | P2 | P1 | P4 | P4 | P1 | P2 | P3 |
| R1 | +V3 | −V3 | −V3 | −V3 | −V3 | −V3 | −V3 | +V3 |
| R2 | +V3 | +V3 | −V3 | +V3 | −V3 | +V3 | −V3 | −V3 |
| R3 | −V3 | +V3 | −V3 | −V3 | −V3 | −V3 | +V3 | −V3 |
| R4 | −V3 | −V3 | −V3 | +V3 | +V3 | −V3 | −V3 | −V3 |

| FN | 4 | | | | | | | |
|---|---|---|---|---|---|---|---|---|
| fN | ODD NUMBER(1,3,···,19) | | | | EVEN NUMBER(2,4,···,20) | | | |
| PATTERN SET | PB | | | | PA | | | |
| PATTERN | P1 | P4 | P3 | P2 | P2 | P3 | P4 | P1 |
| R1 | −V3 | −V3 | +V3 | −V3 | −V3 | +V3 | −V3 | −V3 |
| R2 | −V3 | +V3 | +V3 | +V3 | −V3 | −V3 | −V3 | +V3 |
| R3 | −V3 | −V3 | −V3 | +V3 | +V3 | −V3 | −V3 | −V3 |
| R4 | −V3 | +V3 | −V3 | −V3 | −V3 | −V3 | +V3 | −V3 |

FIG. 14

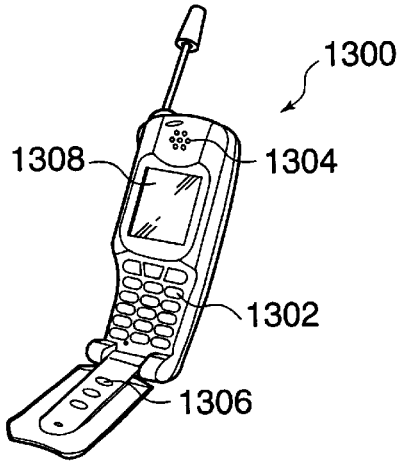
FIG. 17
| P1 | P2 | P3 | P4 | |
|---|---|---|---|---|
| +1 | +1 | -1 | +1 | R1 |
| -1 | +1 | +1 | +1 | R2 |
| +1 | -1 | +1 | +1 | R3 |
| +1 | +1 | +1 | -1 | R4 |
FIG. 18
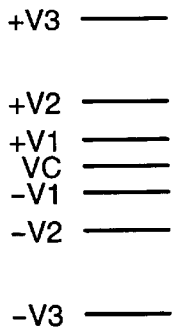
FIG. 19

| | | | | | | | | | | | | | | | |
|---|---|---|---|---|---|---|---|---|---|---|---|---|---|---|---|
| R1 | -1 | -1 | -1 | -1 | -1 | -1 | -1 | -1 | +1 | +1 | +1 | +1 | +1 | +1 | +1 |
| R2 | -1 | -1 | -1 | -1 | -1 | +1 | +1 | -1 | -1 | -1 | -1 | -1 | +1 | +1 | +1 |
| R3 | -1 | -1 | +1 | +1 | -1 | -1 | -1 | +1 | -1 | +1 | +1 | -1 | +1 | +1 | +1 |
| R4 | -1 | +1 | -1 | +1 | -1 | +1 | +1 | -1 | +1 | +1 | -1 | -1 | +1 | -1 | +1 |
| P1 | +V1 | VC | VC | -V1 | +V2 | +V1 | +V1 | VC | VC | VC | -V2 | +V1 | VC | VC | -V1 |
| P2 | +V1 | VC | +V2 | +V1 | VC | -V1 | +V1 | VC | VC | -V1 | VC | -V1 | -V2 | VC | -V1 |
| P3 | +V1 | VC | VC | -V1 | VC | -V1 | -V1 | VC | +V2 | +V1 | +V1 | +V1 | VC | VC | -V1 |
| P4 | +V1 | +V2 | VC | +V1 | VC | +V1 | -V1 | VC | VC | +V1 | -V1 | -V1 | VC | -V2 | -V1 |
| | A | B | B | A | B | A | A | B | B | A | A | B | A | B | A |

FIG. 20

PB1

| P1 | P2 | P3 | P4 | |
|---|---|---|---|---|
| +1 | −1 | −1 | +1 | R1 |
| +1 | +1 | −1 | −1 | R2 |
| +1 | +1 | +1 | +1 | R3 |
| +1 | −1 | +1 | −1 | R4 |

PB2

| P1 | P2 | P3 | P4 | |
|---|---|---|---|---|
| +1 | +1 | −1 | +1 | R1 |
| +1 | −1 | +1 | +1 | R2 |
| +1 | −1 | −1 | −1 | R3 |
| +1 | +1 | +1 | −1 | R4 |

FIG. 23

ELECTRO-OPTICAL APPARATUS AND METHOD OF DRIVING ELECTRO-OPTICAL MATERIAL, DRIVING CIRCUIT THEREFOR, ELECTRONIC APPARATUS, AND DISPLAY APPARATUS

BACKGROUND OF THE INVENTION

1. Field of Invention

The present invention relates to an electro-optical apparatus and a method of driving an electro-optical material that allow display with less unevenness in luminance, a driving circuit therefor, an electronic apparatus, and a display apparatus.

2. Description of Related Art

Generally, in a passive-matrix liquid crystal apparatus, a plurality of scanning electrodes are formed on one substrate and a plurality of signal electrodes are formed on the other substrate, and liquid crystal is held between the substrates as an electrooptical material. Pixels are arranged respectively in association with intersections of the scanning electrodes and the signal electrodes so as to form a matrix. The intensity level of each pixel is determined according to a potential difference between associated scanning electrode and signal electrode.

MLS (Multi-Line Selection) driving, in which a plurality of scanning electrodes are simultaneously selected in a period and the selection period is divided into a plurality of sub-periods within a frame, can be used to drive the above apparatus. In MLS driving, a selection voltage is applied to a pixel a plurality of times in a frame, so that change is luminance of a pixel that is turned on for display is reduced compared with a method in which a selection voltage is applied only once in a frame, serving to avoid reduction in contrast. In the following description, the sub-periods into which one frame is divided will be referred to as fields.

A case where a liquid crystal panel having 4S scanning electrodes is driven by MLS driving is considered below. In this example, it is assumed that four scanning electrodes are simultaneously selected. In the following description, a set of scanning electrodes that are selected simultaneously will be referred to as a scanning electrode group. In this example, S scanning electrode groups G1, G2, . . . GS exist. Furthermore, the first scanning electrodes Y1, Y5, . . . Yk+1, . . . in the respective scanning electrode groups will be referred to as first scanning electrodes R1, the second scanning electrodes Y2, Y6, . . . Yk+2, . . . in the respective scanning electrode groups as second scanning electrodes R2, the third scanning electrodes Y3, Y7, . . . Yk+3, . . . in the respective scanning electrode groups as third scanning electrodes R3, and the fourth scanning electrodes Y4, Y8, . . . Yk+4, . . . in the respective scanning electrode groups as fourth scanning electrodes R4.

In MLS driving, either a positive voltage +V3 or a negative voltage −V3 with reference to a reference voltage VC is selected and applied to scanning electrodes. Each frame is divided into a first field f1, a second field f2, a third field f3, and a fourth field f4, and the scanning electrode groups are sequentially selected in each of the fields.

FIG. 18 is a chart showing polarities of scanning electrode voltage in MLS driving. In FIG. 18, "+1" indicates selection of +V3 as a scanning electrode voltage, whereas "−1" indicates selection of −V3 as a scanning electrode voltage. Furthermore, sets of polarities of selection voltages to be applied respectively to the first to fourth scanning electrodes R1 to R4 that are selected simultaneously will be referred to as first to fourth scanning patterns P1 to P4, and sets of scanning patterns will be referred to as scanning pattern sets. In the example shown in FIG. 18, a column corresponds to a scanning pattern, and a set of the first column to the fourth column corresponds to a scanning pattern set. For example, if the first to fourth scanning patterns P1 to P4 are sequentially used in the first to fourth fields f1 to f4, voltage applied to the first scanning electrodes R1 is +V3 in the first field f1, +V3 in the second field f2, −V3 in the third field f3, and +V3 in the fourth field f4.

Signal electrode voltages are selected from +V2, −V2, +V1, −V1, and VC. A relationship among the potentials +V3, −−V3, +V2, −V2, +V1, −V1, and VC is shown in FIG. 19. Signal electrode voltages are selected based on the number of mismatches between a scanning pattern and a pattern of display data D (hereinafter referred to as a display pattern). If display data D to be displayed on a pixel is off (black) for "0" and on (white) for "1," "0" is associated with "−1" and "1" is associated with "+1."

FIG. 20 is a chart showing an example of selection of signal electrode voltages. In this example, +V2 is selected as a signal electrode voltage if the number of mismatches between scanning pattern and display pattern is "4," +V1 is selected as a signal electrode voltage if the number of mismatches is "3," VC is selected as a signal electrode voltage if the number of mismatches is "2," −V1 is selected as a signal electrode voltage if the number of mismatches is "1," and −V2 is selected as a signal electrode voltage if the number of mismatches is "0."

It can be assumed, as an example, that display pattern corresponding to the first to fourth scanning electrodes R1 to R4 is "−1, −1, −1, −1." Since the first scanning pattern P1 is "+1, −1, +1, +1," the number of mismatches is "3." Accordingly, if display pattern is "−1, −1, −1, −1" as shown in FIG. 20, +V1 is selected as a signal electrode voltage.

If a combination of polarities of scanning electrode voltages simultaneously selected are such that only one of four is mismatched as described above, for example, when all pixels on a signal electrode are off, the signal electrode voltage forms a waveform Q1 shown in FIG. 21, whereby +V1 is applied uniformly throughout one frame. On the other hand, if all pixels on a signal electrode are on, the signal electrode voltage forms a voltage waveform Q2 shown in FIG. 21, whereby −V1 is applied uniformly throughout one frame.

Accordingly, variation in voltages applied to pixels in a non-selection period is eliminated. That is, if a combination of polarities of scanning electrode voltages simultaneously selected is such that only one of four is mismatched, variation in signal electrode voltages is reduced when displaying black text in white background, which is most typical, or when displaying white text in black background.

In MLS driving, however, signal electrode voltages are selected according to a combination of scanning pattern and display pattern. Thus, signal electrode voltages are fixed to a specific pattern in relation to a specific display pattern. FIG. 22 shows an example of display pattern. In this example, black is displayed at pixels indicated by oblique lines while white is displayed at the other pixels, the display pattern shown in FIG. 22 being repeated in the rightward direction and in the downward direction. Signal electrode voltages are selected according to a table shown in FIG. 20.

In this case, the first to fourth columns from the left always display "white." Thus, display pattern of these columns is always "+1, +1, +1, +1," so that voltages at the signal electrodes X1 to X4 are always −V1. On the other hand, the fifth to eighths columns from the left repeatedly displays "white, white, white, black, and black, black, black, white." Thus, display pattern of G1 and G3 in these columns is always "+1, +1, +1, −1," so that voltages at the signal electrodes X5 to X8 are always VC or −V2.

Display pattern of G2 and G4 in these columns is always "−1, −1, −1, +1," so that voltages at the signal electrodes X5 to X8 are always VC or +V2. That is, voltages at the signal electrodes X1 to X4 are always −VC, whereas voltages at the signal electrodes X5 to X8 are always VC or ±V2.

Since the signal electrodes oppose the scanning electrodes via liquid crystal, capacitance is present. Furthermore, capacitance of liquid crystal changes depending on a voltage being applied.

Thus, actual voltage waveforms at the signal electrodes do not rise or fall sharply, and include distortions attributable to capacitive component.

The degree of distortion of the voltage waveforms is determined according to frequency components of the voltage waveforms. In the example described above, voltages at the signal electrodes X1 to X4 are always −VC, so that distortion is substantially absent. In contrast, voltages at the signal electrodes X5 to X8 are VC or +V2, so that distortion of waveforms is larger compared with the voltages at the signal electrodes X1 to X4. Luminance of each pixel is determined according to the effective voltage applied to liquid crystal. Thus, pixels driven by signal electrode voltages with less distortion and pixels driven by signal electrode voltages with larger distortion differ in luminance. In this example, white displayed on the first to fourth columns and white displayed on the fifth to eighth columns differ in luminance. Accordingly, unevenness in luminance occurs every four columns.

As described above, in MLS driving, signal electrode voltages are fixed to a specific pattern in relation to a specific display pattern, causing unevenness in luminance. A technique to address or solve this problem is disclosed in Japanese Unexamined Patent Application Publication No. 7-281645. According to the technique, a plurality of scanning patterns are sequentially selected, so that bias will not be present in frequency components of voltage waveforms at signal electrodes. As described above, which voltage to select for application to signal electrodes is determined based on a display pattern and a scanning pattern. Thus, even if the display pattern is fixed, bias in frequency components of voltage waveforms at signal electrodes can be removed by changing the scanning pattern.

SUMMARY OF THE INVENTION

Signal electrode voltages must be selected based on a display pattern and a scanning pattern. Thus, when the arrangement is such that a plurality of scanning patterns are alternately used, a processing circuit becomes complex.

A type of such a processing circuit includes a plurality of switches respectively associated with signal electrodes, and a memory. Each of the switches selects and outputs a voltage from a plurality of voltages based on selection data. The memory stores in advance a display pattern and a scanning pattern set in association with selection data. In such an arrangement, required capacity of the memory doubles when the number of scanning pattern doubles.

The present invention addresses the above situation, and provides a method of driving an electro-optical apparatus in which a plurality of scanning pattern sets can be alternated in a simple construction, a driving circuit, and an electronic apparatus.

In order to address or solve the problems described above, a method of driving an electro-optical apparatus according to the present invention is used in an electrooptical apparatus constructed such that a plurality of scanning electrodes and a plurality of signal electrodes are disposed so as to hold an electro-optical material therebetween and to cross each other, the plurality of scanning electrodes are divided into a plurality of scanning electrode groups that each have a predetermined number of scanning electrodes, a scanning electrode group is selected a plurality of times in each frame, a positive selection voltage or a negative selection voltage with reference to a reference voltage at a center potential is applied to each of the scanning electrodes belonging to the scanning electrode group during the selection period according to a scanning pattern set including a plurality of predetermined scanning patterns, a display pattern that specifies whether to turn on or turn off a plurality of pixels associated with intersections on the scanning electrodes belonging to the scanning electrode group is compared with the scanning pattern, and voltages selected from a plurality of predetermined voltages are applied respectively to the signal electrodes based on the number of mismatches between elements of the display pattern and elements of the scanning pattern. A first and a second scanning pattern sets are alternately used on a basis of a predetermined period to apply voltages respectively to the scanning electrodes and to apply voltages respectively to the signal electrodes, and the first scanning pattern set is such that elements associated with a scanning electrode are inverted in the second scanning pattern set.

According to this invention, the signal electrodes are driven using the two scanning pattern sets, so that bias in frequency components of signal electrode voltages is removed. Furthermore, since the first scanning pattern set is such that elements associated with a scanning electrode are inverted in the second scanning pattern set. Thus, when scanning electrodes are driven according to the first scanning pattern set, voltages to be applied respectively to signal electrodes can be determined based on the number of mismatches between a display pattern in which elements associated with the scanning electrode are inverted and scanning patterns belonging to the second scanning pattern set.

Preferably, the first scanning pattern set is applied to some of the scanning electrode groups, whereas the second scanning pattern set is applied to the other scanning electrode groups. More preferably, adjacent scanning electrode groups are driven using different scanning pattern sets. According to this invention, scanning pattern sets are alternated within one frame, so that bias in frequency components of signal electrode voltage is further removed.

Furthermore, preferably, the electro-optical material is liquid crystal, voltages of a polarity indicated by the scanning pattern and voltages of a polarity opposite to the polarity indicated by the scanning pattern are alternately applied to the scanning electrodes on a basis of a predetermined period of inversion, and the first scanning pattern set and the second scanning pattern set are alternated on a basis of each period of the inversion of polarity. In particular, if the period of inversion is two frames, preferably, in a two-frame period, the first scanning pattern set is applied to a first scanning electrode group of a pair of adjacent scanning electrode groups whereas the second scanning pattern set is applied to a second scanning electrode group thereof, and in a next two-frame period, the second scanning pattern set is applied to the first scanning electrode group of the pair of adjacent scanning electrode groups whereas the first scanning pattern set is applied to the second scanning electrode group.

When liquid crystal, which is an electro-optical material, is driven by AC, polarities of voltages applied to the scanning electrodes are inverted on a basis of a predetermined inversion period. If driving ability of a circuit that applies voltages to the signal electrodes is low, distortion in voltage waveforms at the signal electrodes varies depending on the scanning pattern sets. Thus, if the scanning pattern sets are alternated within one inversion period, DC voltage may be applied to the liquid crystal. Accordingly, in the invention described above, the association between the scanning electrode groups and the scanning pattern sets is fixed within an inversion period, while the association between the scanning electrode groups and the scanning pattern sets is alternated on a basis of each inversion period.

Also preferably, the relationship of each of the scanning patterns belonging to the second scanning pattern set and the display pattern to voltages to be applied to the signal electrodes is stored in advance, when the first scanning pattern set is applied, display data associated with scanning electrodes associated with inverted elements in the second scanning pattern set is inverted, the display pattern is generated based on the inverted display data, and voltages to be applied to the signal electrodes are determined based on the generated display pattern and the scanning patterns and with reference to stored content.

Voltages to be applied to the signal electrodes are determined based on the number of mismatches obtained by comparing elements of the scanning patterns and elements of the display pattern. The display pattern is determined based on display data. Thus, if an alternative scanning pattern with different elements is used instead of a scanning pattern, display data associated with mismatched elements are inverted, and voltages to be applied to the signal electrodes are determined based on the number of mismatches between the display pattern thus generated and the scanning pattern. The invention described above has been made in view of the above, and according to the invention, the relationship between the second scanning pattern set and voltages to be applied to the signal electrodes is stored in advance, and voltages to be applied to the signal electrodes are determined based on a display pattern generated by inverting particular display data when the first scanning pattern set is applied.

Accordingly, the relationship between the first scanning pattern set and voltages to be applied to the signal electrodes need not be stored in advance.

A driving circuit to drive an electro-optical apparatus according to the present invention is used in an electro-optical apparatus constructed such that a plurality of scanning electrodes and a plurality of signal electrodes are disposed so as to hold an electrooptical material therebetween and to cross each other. The driving circuit is provided such that the plurality of scanning electrodes are divided into a plurality of scanning electrode groups that each have a predetermined number of scanning electrodes; a scanning electrode group is selected a plurality of times in each frame; a positive selection voltage or a negative selection voltage with reference to a reference voltage at a center potential is applied to each of the scanning electrodes belonging to the scanning electrode group during the selection period according to a scanning pattern set including a plurality of predetermined scanning patterns; a display pattern that specifies whether to turn on or turn off a plurality of pixels associated with intersections on the scanning electrodes belonging to the scanning electrode group is compared with the scanning pattern; and voltages selected from a plurality of predetermined voltages are applied respectively to the signal electrodes based on the number of mismatches between elements of the display pattern and elements of the scanning pattern. The driving circuit includes a storage device that stores scanning patterns constituting a reference scanning pattern set that is one of a plurality of scanning pattern sets, and a display pattern, in association with selection data for selecting voltages to be applied to the signal electrodes; a scanning pattern control device that generates a scanning pattern control signal for selecting one of the scanning patterns according to a predetermined rule; a data control device that determines which scanning pattern set to use and for inverting display data based on mismatch between elements in the scanning pattern set determined and elements in the reference scanning pattern set; a display pattern generating device that generates a display pattern based on output data from the data control unit; and a signal electrode voltage application device that applies voltages to signal electrodes according to selection data read from the storage device based on the display pattern generated by the display pattern generating device and the scanning pattern control signal.

According to this invention, the data control device determines which scanning pattern set to use, and inverts display data based on mismatch between elements in s scanning pattern set determined and the reference scanning pattern set. Thus, it suffices for the storage device to store only selection data corresponding to the reference scanning pattern set. Accordingly, required storage capacity of the storage device can be considerably reduced.

The driving circuit according to the present invention may further include a scanning electrode voltage application device to apply voltages to the scanning electrodes based on the scanning pattern control signal.

Furthermore, preferably, the number of the plurality of scanning pattern sets is two, the scanning pattern set other than the reference scanning pattern set is such that elements associated with a scanning electrode are inverted in the reference scanning pattern set, and the data control device inverts display data associated with the scanning electrode for output when the scanning pattern set other than the reference scanning pattern set is used. In that case, display data associated with a particular horizontal scanning line is to be inverted. Thus, for example, the data control device counts a horizontal synchronization signal and inverts display data based on the count, which can be implemented in a simple construction.

An electronic apparatus according to the present invention includes an electro-optical panel constructed such that a plurality of scanning electrodes and a plurality of signal electrodes are disposed so as to hold an electro-optical material therebetween and to cross each other; and a driving circuit to drive the electro-optical panel, in which the plurality of scanning electrodes are divided into a plurality of scanning electrode groups that each have a predetermined number of scanning electrodes, a scanning electrode group is selected a plurality of times in each frame, a positive selection voltage or a negative selection voltage with reference to a reference voltage at a center potential is applied to each of the scanning electrodes belonging to the scanning electrode group during the selection period according to a scanning pattern set including a plurality of predetermined scanning patterns, a display pattern that specifies whether to turn on or turn off a plurality of pixels associated with intersections on the scanning electrodes belonging to the scanning electrode group is compared with the scanning pattern, and voltages selected from a plurality of predetermined voltages are applied respectively to the signal electrodes based on the number of mismatches between elements of the display pattern and elements of the scanning pattern. The driving circuit includes a storage device that stores scanning patterns constituting a reference scanning pattern set that is one of a plurality of scanning pattern sets, and a display pattern, in association with selection data for selecting voltages to be applied to the signal electrodes; a scanning pattern control device that generates a scanning pattern control signal for selecting one of the scanning patterns according to a predetermined rule; a data control device that determines which scanning pattern set to use and that inverts display data based on mismatch between elements in the scanning pattern set determined and elements in the reference scanning pattern set; a display pattern generating device that generates a display pattern based on output data from the data control unit; and a signal electrode voltage application device that applies voltages to signal electrodes according to selection data read from the storage device based on the display pattern generated by the display pattern generating device and the scanning pattern control signal. Such electronic apparatuses include, for example, various display apparatuses, such as television sets and monitors, communication apparatuses, such as cellular phones and PDAs, and information processing apparatuses, such as personal computers, for example.

In a method of driving an electro-optical material according to the present invention, four of a plurality of scanning electrodes to select a plurality of electro-optical materials are simultaneously selected and a signal voltage defining intensity levels of display by the plurality of electro-optical materials are applied to signal electrodes in each of four fields within one frame. The method of driving an electro-optical material includes a first step of applying either a first voltage or a second voltage of the same magnitude and a different polarity with respect to the first voltage to the signal electrodes as the signal voltage; and a second step of applying one of a third voltage of a different magnitude with respect to the first and second voltages, a fourth voltage of the same magnitude and a different polarity with respect to the third voltage, and a center voltage between the third and fourth voltages, to the signal electrodes as the signal voltage. Preferably, the first step and the second step are alternately executed on a basis of each field.

According to these features, voltages respectively applied as the signal voltage in the first step and in the second step are certain to differ from each other. Accordingly, bias in frequency components of signal voltages is removed.

In a driving circuit to drive an electro-optical material according to the present invention, four of a plurality of scanning electrodes for selecting a plurality of electro-optical materials are simultaneously selected and a signal voltage defining intensity levels of display by the plurality of electro-optical materials are applied to signal electrodes in each of four fields within one frame. Either a first voltage or a second voltage of the same magnitude and a different polarity with respect to the first voltage is applied to the signal electrodes as the signal voltage; and one of a third voltage of a different magnitude with respect to the first and second voltages, a fourth voltage of the same magnitude and a different polarity with respect to the third voltage, and a center voltage between the third and fourth voltages, is applied to the signal electrodes as the signal voltage. Preferably, application of either the first voltage or the second voltage and application of one of the third voltage, the fourth voltage, and the center voltage are alternately executed on a basis of each field.

A display apparatus according to the present invention includes the driving circuit to drive an electro-optical material as described above.

BRIEF DESCRIPTION OF THE DRAWINGS

FIG. 2 is a timing chart showing a relationship between a frame and fields in distributed driving.

FIG. 3 is a timing chart showing a relationship between a frame and fields in non-distributed driving.

FIG. 4 is a chart showing a content of a second scanning pattern set PB.

FIG. 5 is a chart showing a selection relationship between display patterns and signal electrode voltages.

FIG. 14 are charts showing relationship of voltages applied to first to fourth scanning electrodes R1 to R4 to scanning patterns, scanning pattern sets, a scanning number signal fN, and a frame number signal FN.

FIG. 17 is a perspective view showing the construction of a cellular phone that is an example of electronic apparatus to which a liquid crystal apparatus according to the present invention is applied.

FIG. 18 is a chart showing polarities of scanning electrode voltages in MLS driving.

FIG. 19 is a schematic showing relationship among potentials +V3, −V3, +V2, −V2, +V1, −V1, and VC.

FIG. 20 is a chart showing an example of selection of signal electrode voltages.

FIG. 23 are charts showing another example of the second scanning pattern set PB.

DETAILED DESCRIPTION OF PREFERRED EMBODIMENTS

Embodiments of the present invention will be described below with reference to the drawings. The embodiments only illustrate modes of the present invention without limitation thereto, and modifications are possible as desired within the scope of the present invention. For example, the present invention can be applied to other electrooptic devices, particularly any electrooptic devices performing a gradation display by using pixels for on-and-off binary display. Possible examples of such electrooptic devices include an electroluminescence device, a plasma display, and the like.

Embodiments of the present invention will now be described with reference to the drawings.

<Driving Method>

Figure 1:
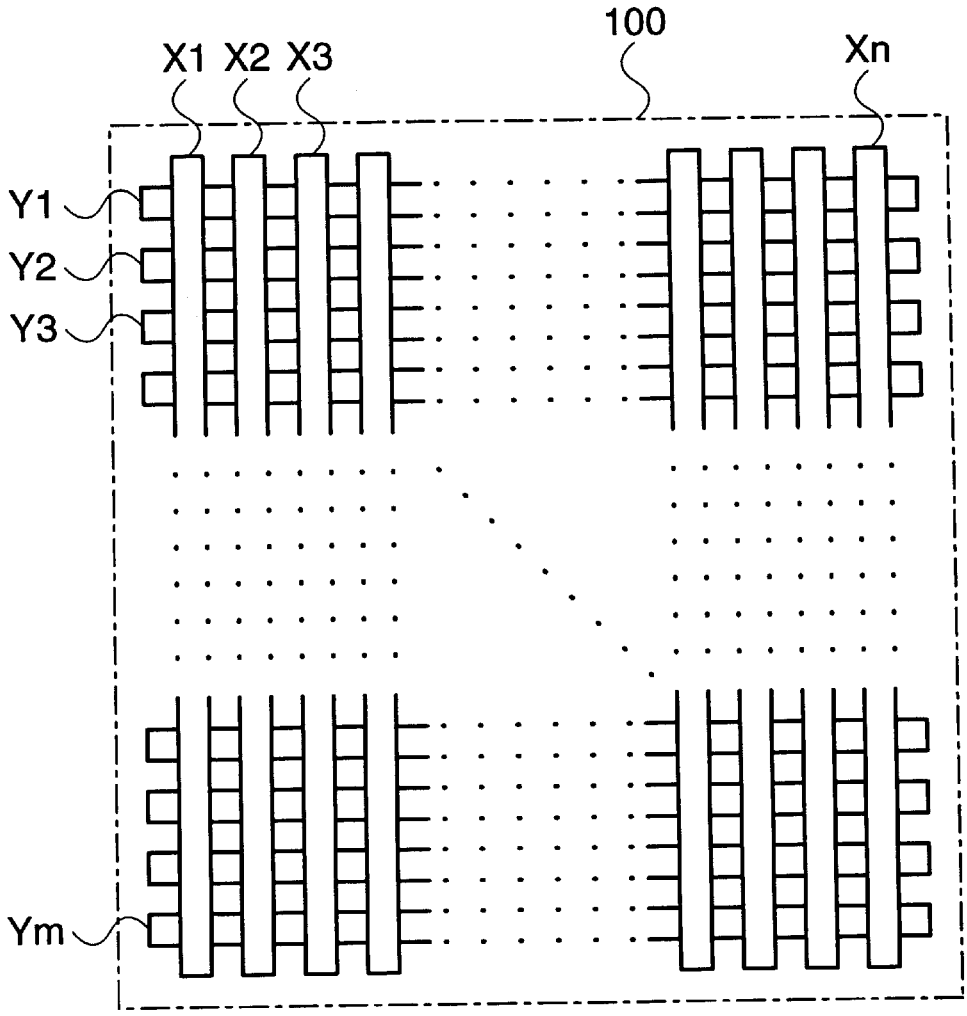
FIG. 1 is a schematic showing the mechanical construction of scanning electrodes and signal electrodes in a liquid crystal apparatus according to an embodiment of the present invention.

First, an electro-optical apparatus according to an embodiment of the present invention will be described, by way of example, in the context of a liquid crystal apparatus, which uses liquid crystal as an electro-optical material. FIG. 1 is a schematic showing the mechanical construction of scanning electrodes and signal electrodes of a liquid crystal apparatus. Referring to FIG. 1, a liquid crystal panel 100, which is a liquid crystal apparatus, includes m scanning (common) electrodes Y1 to Ym extending in a row direction, and n signal (segment) electrodes X1 to Xn extending in a column direction. The liquid crystal panel 100 also includes a pair of substrates. The scanning electrodes Y1 to Ym are formed on one of the substrates, and the signal electrodes X1 to Xn are formed on the other substrate. Furthermore, a liquid crystal is held between the pair of substrates. Accordingly, pixels are formed at intersections of the scanning electrodes Y1 to Ym and the signal electrodes X1 to Xn by the electrodes and liquid crystal held therebetween, forming an m×n matrix.

In the following description, it is assumed that m=80 and n=160. Furthermore, in this embodiment, the liquid crystal panel 100 is driven by MLS driving in which four scanning electrodes are simultaneously selected. The scanning electrodes Y1 to Y80 are divided into scanning electrode groups G1 to G20. Furthermore, the first scanning electrodes Y1, Y5, . . . Yk+1, . . . Y77 in the respective scanning electrode groups will be referred to as first scanning electrodes R1, the second scanning electrodes Y2, Y6, . . . Yk+2, . . . Y78 in the respective scanning electrode groups as second scanning electrodes R2, the third scanning electrodes Y3, Y7, . . . Yk+3, . . . Y79 in the respective scanning electrode groups as third scanning electrodes R3, and the fourth scanning electrodes Y4, Y8, . . . Yk+4, . . . Y80 in the respective scanning electrode groups as fourth scanning electrodes R4.

MLS driving can be classified into distributed driving and non-distributed driving. In distributed driving, scanning electrode groups are sequentially selected in a field, the scanning electrode groups are sequentially selected similarly in a next field, and this is repeated until one frame completes. FIG. 2 is a timing chart showing relationship between a frame and fields in distributed driving. As shown in FIG. 2, in distributed driving, one frame 1F includes a first field f1, a second field f2, a third field f3, and a fourth field f4. The scanning electrode groups G1 to G20 are sequentially selected in each of the fields.

As opposed to the above, in non-distributed driving, first to fourth scanning patterns P1 to P4 are alternately used in each period in which a scanning electrode group is selected, a next scanning electrode group is selected at a next timing, and this is repeated until one frame completes. FIG. 3 is a timing chart showing relationship between a frame and fields in non-distributed driving. As shown in FIG. 3, in non-distributed driving, each period in which one of the scanning electrode groups G1 to G20 is selected includes first to fourth fields f1 to f4. That is, in non-distributed driving, once a scanning electrode group is selected, switching of the first to fourth scanning patterns P1 to P4 in the current frame is executed in a concentrated manner. A driving method according to this embodiment can be applied to either of distributed driving and non-distributed driving.

The polarities of scanning electrode voltages in each of the fields are selected according to the scanning pattern sets. In this embodiment, a first scanning pattern set PA and a second scanning pattern set PB are periodically alternated. The first scanning pattern set PA is shown in FIG. 18. The second scanning pattern set PB is shown in FIG. 4. When the first scanning pattern set PA is compared with the second scanning pattern set PB, the second scanning pattern set PB is such that "+1" is replaced with "−1" and "−1" with "+1" in the second row of the first scanning pattern set PA. That is, the polarities of selection voltages applied to the second scanning electrodes R2 (Y2, Y6, . . . Yk+2, . . . Y78) are opposite in the first scanning pattern set PA and the second scanning pattern set PB.

FIG. 5 is a chart showing selection relationship between display pattern and signal electrode voltages. In the following description, a waveform pattern with a signal electrode voltage of ±V1 will be referred to as a first set A, and a waveform pattern with a signal electrode voltage of VC or ±V2 as a second set B. From a comparison of signal electrode voltages in the first scanning pattern set PA shown in FIG. 20 with signal electrode voltages in the second scanning pattern set PB shown in FIG. 5, it is understood that the first set A and the second set B are alternated. That is, when the polarities of scanning electrode voltages associated with a scanning electrode are inverted in a scanning pattern set, the first set A and the second set B are alternated. Thus, by periodically alternating the first scanning pattern set PA and the second scanning pattern set PB, bias in signal electrode voltages is removed.

Signal electrode voltages are determined based on the number of mismatches between display pattern and scanning pattern. In this embodiment, a non-volatile memory (storage circuit 1405 to be described below) is used, which stores a display pattern in association with selection data Ds for selecting a signal electrode voltage. The non-volatile memory only stores selection data Ds corresponding to the first scanning pattern set PA, and does not store selection data Ds corresponding to the second scanning pattern set PB. When the second scanning pattern set PB is used, display data d associated with the second scanning electrodes R2 is inverted, and the non-volatile memory is accessed based on the result.

The inverted display data d' is used because of the following reason. If white in display pattern is associated with "+1" and black with "−1," and if positive polarity in scanning pattern is associated with "+1" and negative polarity with "−1," signal electrode voltages are selected based on the number of mismatches between display pattern and scanning pattern. The second scanning pattern set PB is such that elements associated with the second scanning electrodes R2 in the first scanning pattern set PA are inverted (elements enclosed in a thick frame in FIG. 4). Because the number of mismatches is determined by comparing elements of display pattern with corresponding elements in scanning pattern element by element, inversion of an element in scanning pattern is equivalent to inversion of a corresponding element in display pattern.

More specifically, the first scanning pattern P1 in the first scanning pattern set PA is "+1, −1, +1, +1." In the second scanning pattern set PB, elements associated with the second scanning electrodes R2 in the first scanning pattern set PA are inverted. Thus, the first scanning pattern P1 in the second scanning pattern set PB is "+1, +1, +1, +1."

It can be assumed that the display pattern is "+1, +1, +1, +1." When the display pattern is compared with the first scanning pattern P1 in the second scanning pattern set PB, the number of mismatches is "0."

In this embodiment, however, selection data corresponding to the second scanning pattern set PB is not stored. Instead, of the display pattern "+1, +1, +1, +1," elements associated with the second scanning electrodes R2 are inverted. That is, "+1, −1, +1, +1" is compared with the first scanning pattern P1 "+1, −1, +1, +1" in the first scanning pattern set PA to obtain the number of mismatches "0." Thus, inversion of an element in a scanning pattern is equivalent to inversion of a corresponding element in the display pattern.

Since it suffices for the non-volatile memory to store only selection data corresponding to the first scanning pattern set PA in association with a display pattern, required capacity of the non-volatile memory can be considerably reduced.

<Overall Construction of Liquid Crystal Apparatus>

Figure 6:
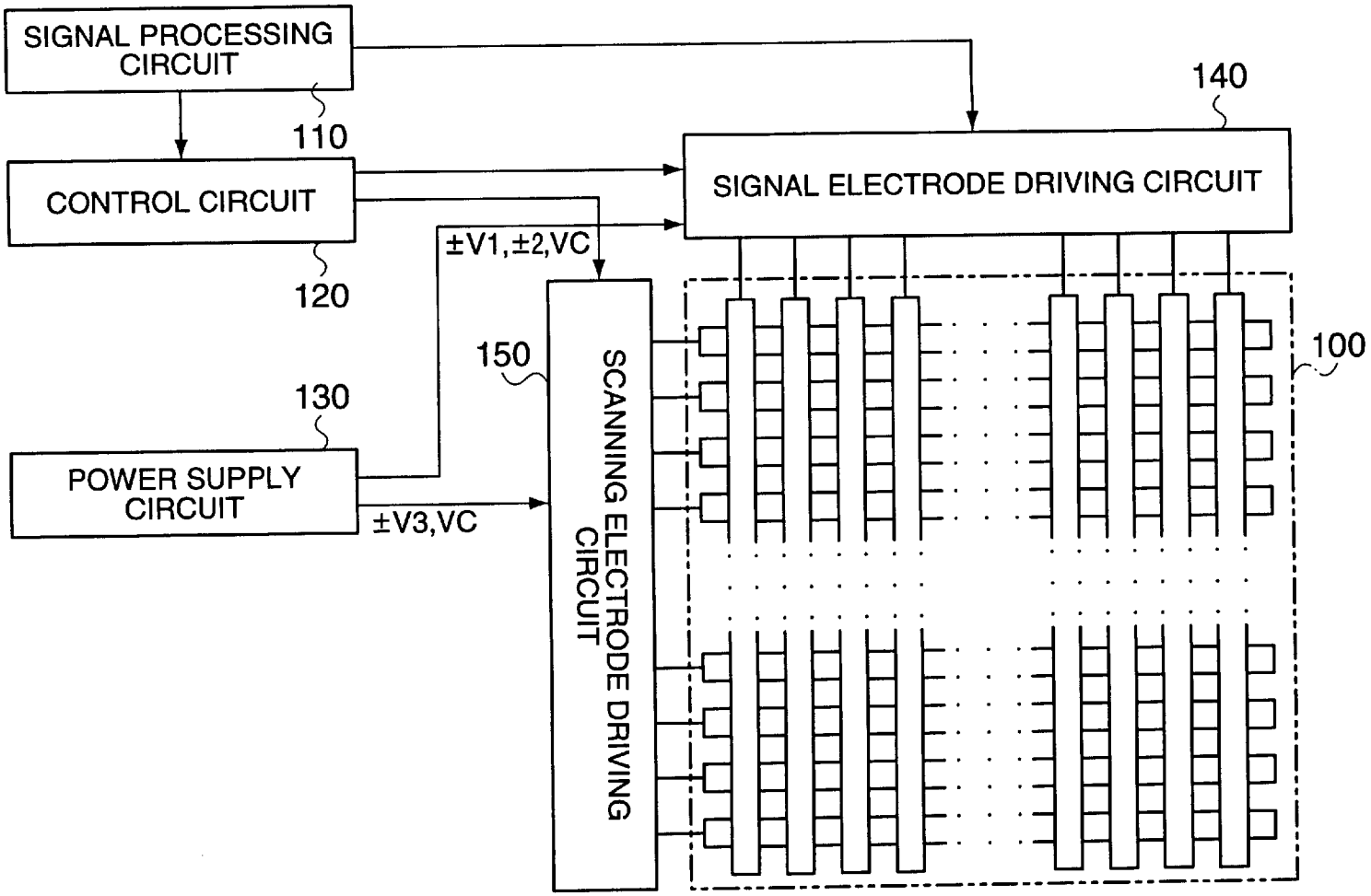
FIG. 6 is a schematic showing the overall construction of the liquid crystal apparatus.

Next, the overall construction of the liquid crystal apparatus according to this embodiment will be described. FIG. 6 is a schematic showing the overall construction of a liquid crystal apparatus according to this embodiment. The liquid crystal apparatus employs non-distributed driving. A signal processing circuit 110 supplies display data d that defines content of display to a signal electrode driving circuit 140, and also supplies various timing signals to a control circuit 120.

A power supply circuit 130 generates ±V3 (selection voltage) and VC (non-selection voltage) that are to be applied to scanning electrodes, and supplies these voltages to a scanning electrode driving circuit 150. The power supply circuit 130 also generates ±V2, ±V1, and VC that are to be applied to signal electrodes, and supplies these voltages to the signal electrode driving circuit 140. The voltage VC is a midpoint voltage between ±V2 and ±V1 that are used as data signals, and it serves as a reference of polarity. Thus, in this embodiment, a positive voltage refers to a voltage higher than the voltage VC, and a negative voltage refers to a voltage lower than the voltage VC. The scanning electrode driving circuit 150, the signal electrode driving circuit 140, the control circuit 120, and the power supply circuit 130 can be integrally constructed in the form of a single chip. Such a construction is advantageous in terms of mounting of the liquid crystal panel 100, reduction in circuitry scale, etc.

<Control Circuit>

Figure 7:
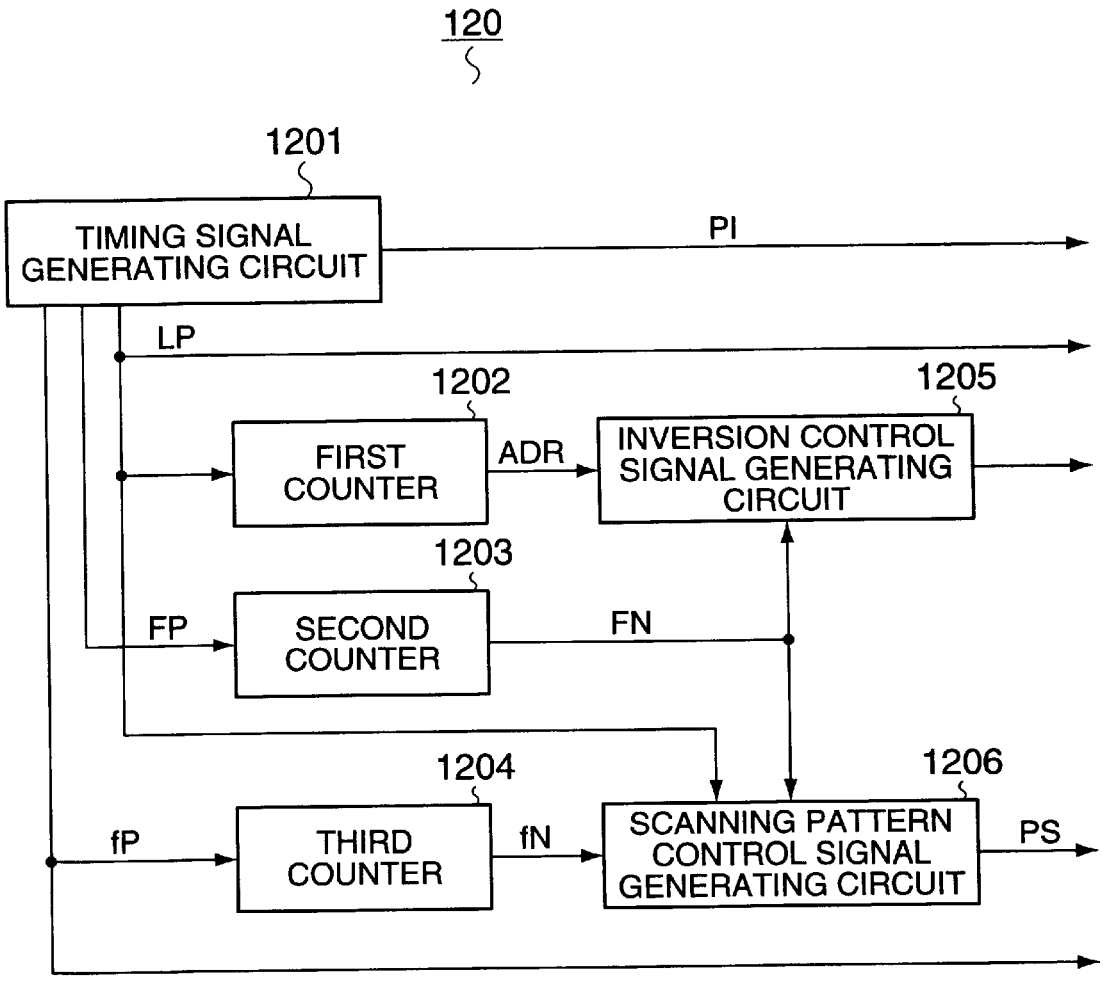
FIG. 7 is a schematic showing the construction of a control circuit 120.
Figure 8:
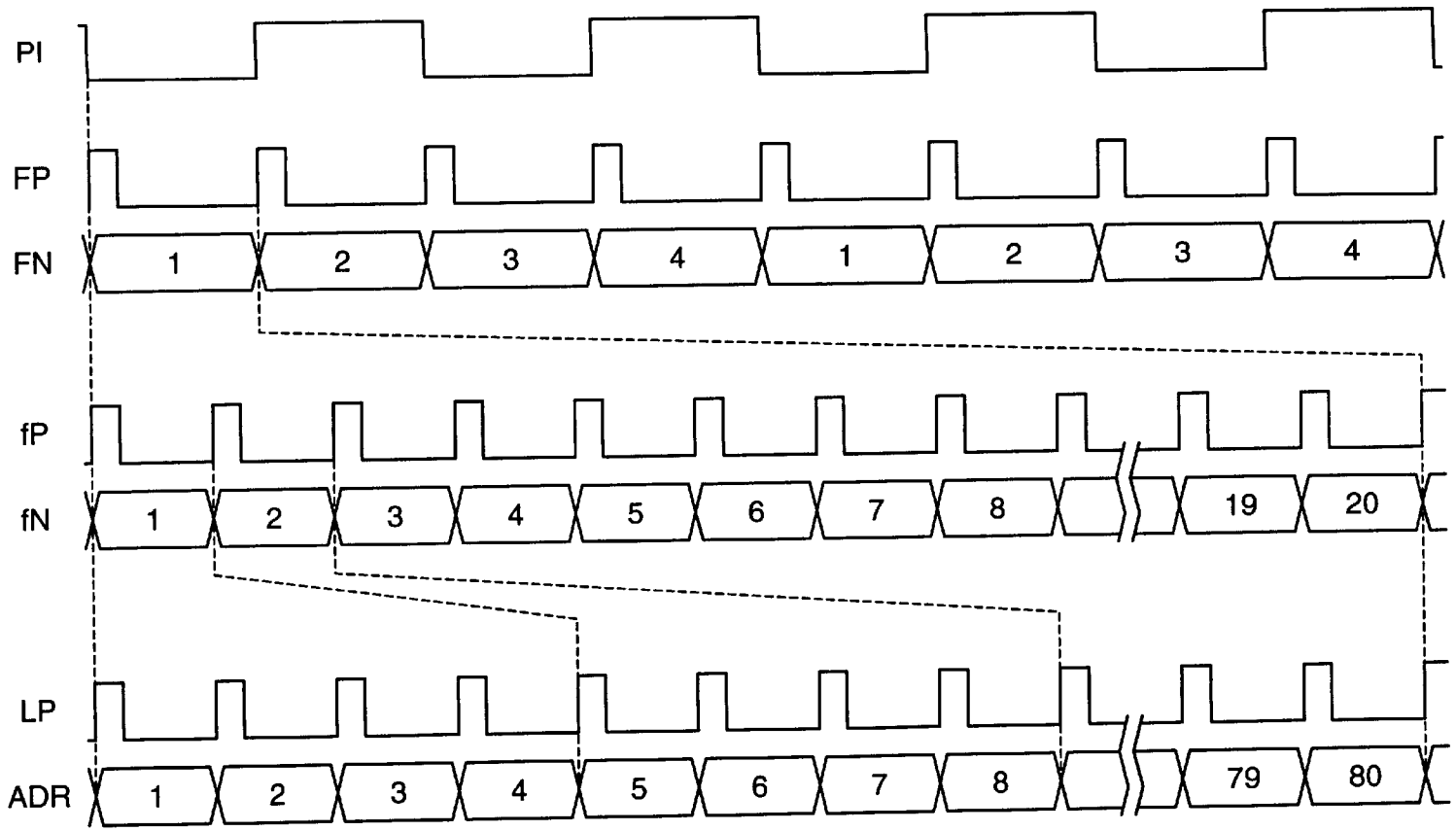
FIG. 8 is a timing chart of the control circuit 120.

Next, the control circuit 120 will be described. FIG. 7 is a schematic showing the construction of the control circuit 120, and FIG. 8 is a timing chart thereof. As shown in FIG. 7, the control circuit 120 includes a timing signal generating circuit 1201, a first counter 1202, a second counter 1203, a third counter 1204, an inversion control signal generating circuit 1205, and a scanning pattern control signal generating circuit 1206.

The timing signal generating circuit 1201 generates signals synchronized with display data d based on a timing signal supplied from the signal processing circuit 110. The signals that are generated include a polarity inversion signal PI, a latch pulse LP, a scanning pulse fP, and a frame pulse FP. The polarity inversion signal P1 is pulled to low level in odd-numbered frames, whereas it is pulled to high level in even-numbered frames. The polarity inversion signal PI is used to invert the polarities of scanning electrode voltage and signal electrode voltage frame by frame.

The frame pulse FP has a period equivalent to one frame, and it goes active at the beginning of each frame. The latch pulse LP has a period equivalent to horizontal scanning period, and it goes active at the beginning of each horizontal scanning period. The scanning pulse fP goes active at the beginning of each selection period of a scanning electrode group. In this embodiment, a selection period of a scanning electrode group is equivalent to four horizontal scanning periods. Thus, the scanning pulse fP has a period four times as long as that of the latch pulse LP. Since the liquid crystal apparatus according to this embodiment employs non-distributed driving described earlier, when a scanning electrode group is selected, the first to fourth scanning patterns P1 to P4 are sequentially alternated in the selection period. That is, a horizontal scanning period corresponds to a field, and the scanning patterns are alternated in each horizontal scanning period.

The first counter 1202 counts the latch pulse LP, outputting the count as a row address signal ADR. The row address signal ADR takes on one of the values 1 to 80.

The second counter 1203 is a two-bit counter, and it counts the frame pulse FP, outputting the count as a frame number signal FN. The frame number signal FN takes on one of the values 1 to 4, indicating the number of a current frame.

The third counter 1204 counts the scanning pulse fP, outputting the count as a scanning number signal fN. The scanning number signal fN takes on one of the values 1 to 20, indicating the number of a scanning electrode group that is currently selected.

Figure 9:
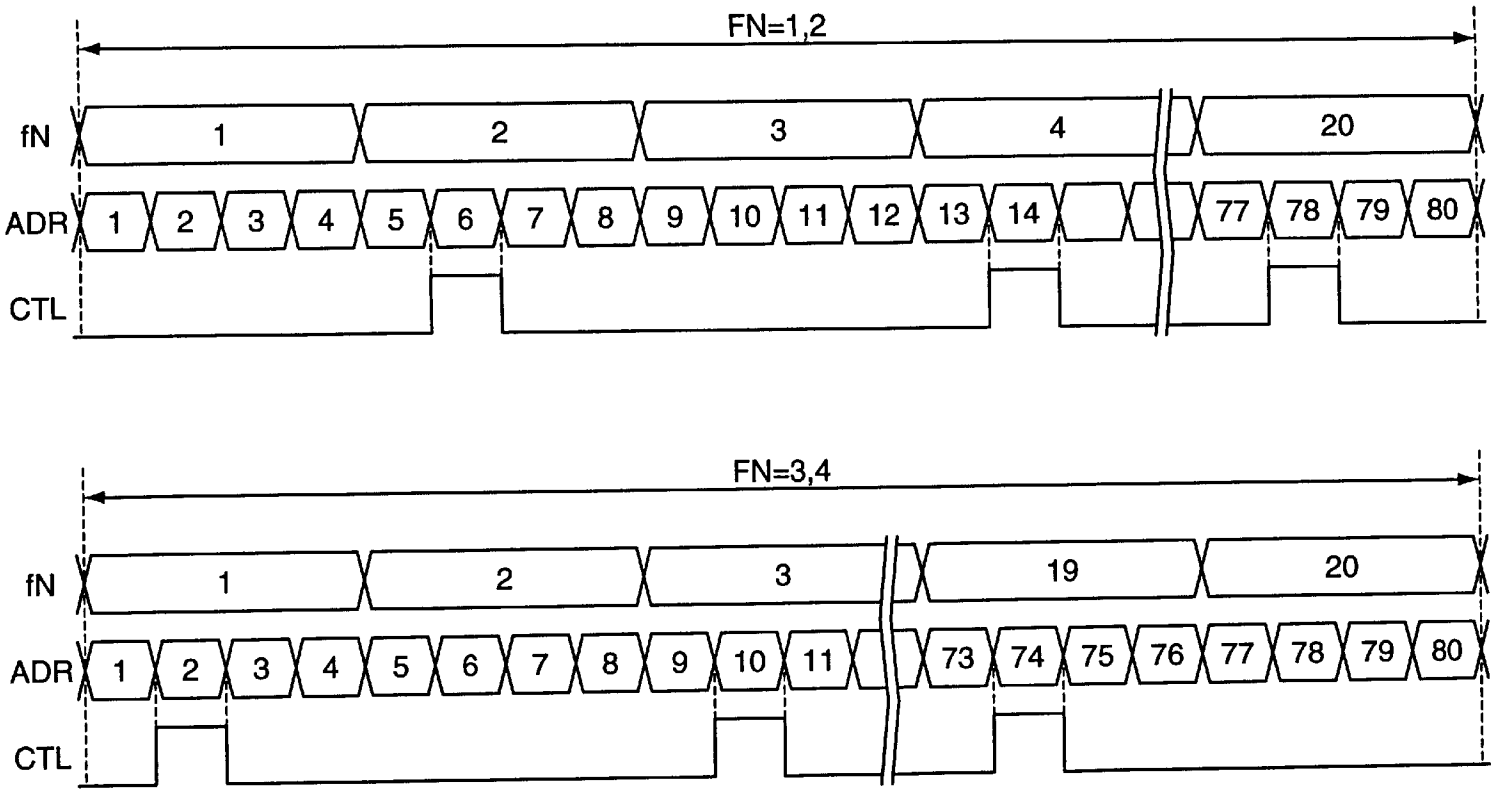
FIG. 9 is a timing chart showing a waveform of an inversion control signal CTL.

The inversion control signal generating circuit 1205 generates an inversion control signal CTL based on the frame number signal FN and the row address signal ADR. The inversion control signal CTL is active at high level, and it instructs inversion of display data d when it is active. When the value of FN is "1" or "2," the inversion control signal generating circuit 1205 activates the inversion control signal CTL if the remainder of the value of ADR divided by eight is "6" while deactivating the inversion control signal CTL if the remainder is other than "6." When the value of FN is "3" or "4," the inversion control signal generating circuit 1205 activates the inversion control signal CTL if the remainder of the value of ADR divided by eight is "2" while deactivating the inversion control signal CTL if the remainder is other than "2." Thus, the inversion control signal CTL has a waveform shown in FIG. 9.

In this example, the inversion control signal CTL is only activated in the first and second frames (FN=1, 2) when the value of the scanning number signal fN is even-numbered. This is because in these frames the first scanning pattern set PA is used when the value of the scanning number signal fN is odd-numbered whereas the second scanning pattern set PB is used when the value is even-numbered. By similar reason, the inversion control signal CTL is activated in the third and fourth frames (FN=3, 4) only when the value of the scanning number signal fN is odd-numbered.

The scanning pattern control signal generating circuit 1206 generates a scanning pattern control signal PS based on the frame number signal FN, the scanning number signal fN, and the latch pulse LP. The scanning pattern control signal PS has two bits, and it indicates a current scanning pattern is which of the first to fourth scanning patterns P1 to P4.

Figure 10:
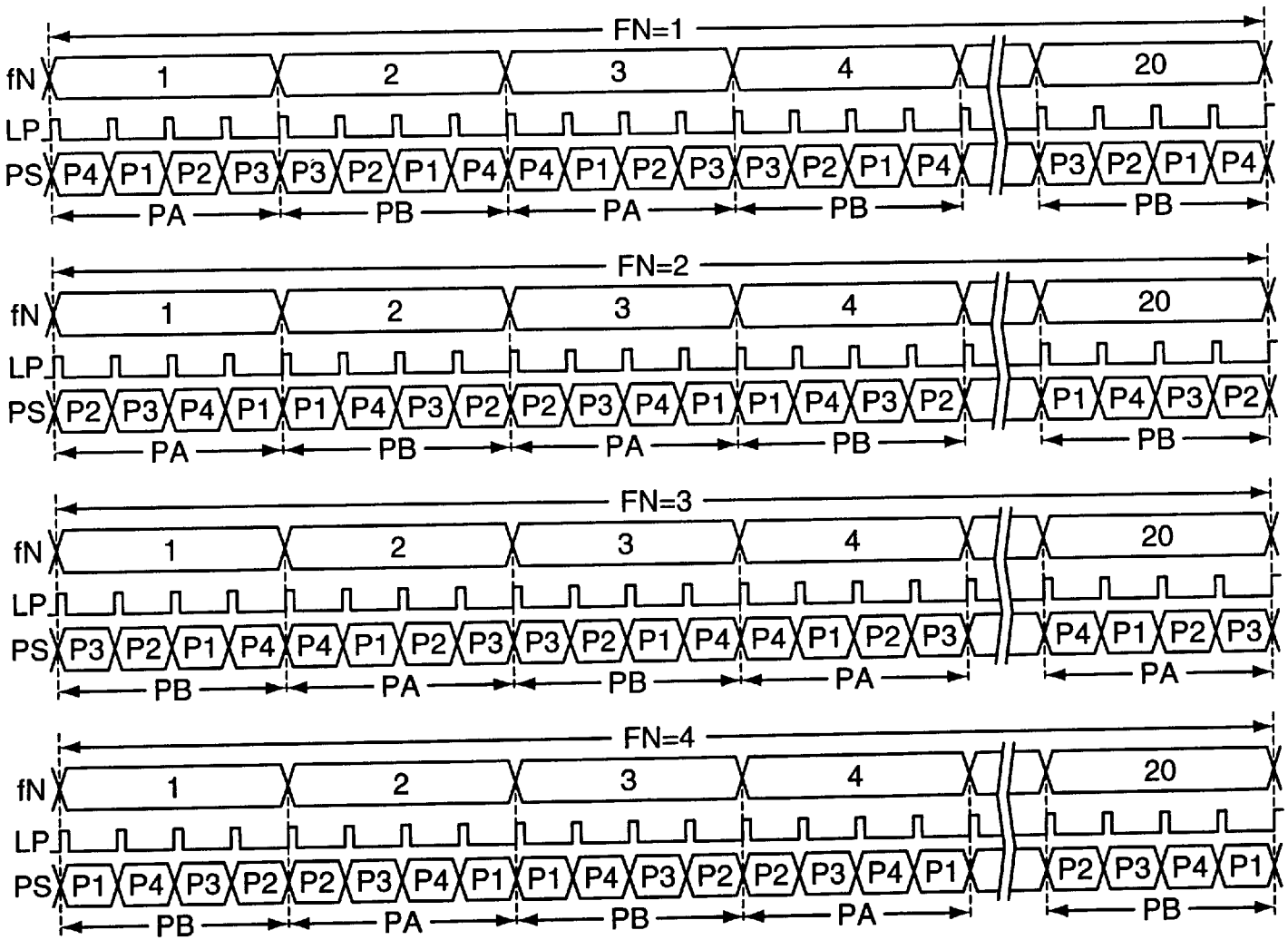
FIG. 10 is a timing chart showing operation of a scanning pattern control signal generating circuit 1206.

FIG. 10 is a timing chart showing operation of the scanning pattern control signal generating circuit 1206. The sequence of scanning patterns is defined as follows. First, the first scanning pattern set PA and the second scanning pattern set PB are alternated on a basis of each selection period of a scanning electrode group. In this embodiment, in the first frame (FN=1), the first scanning pattern set PA is used in odd-numbered selection periods (fN being odd-numbered), whereas the second scanning pattern set PB is used in even-numbered selection periods (fN being even-numbered). Accordingly, the signal electrode voltages are prevented from being a fixed pattern even if the picture is fixed.

Second, the first scanning pattern set PA and the second scanning pattern set PB are alternated on a basis of the period of polarity inversion (i.e., every two frames). In this embodiment, in the first and second frames (FN=1, 2), the first scanning pattern set PA is used in odd-numbered selection periods (fN being odd-numbered) and the second scanning pattern set PB is used in even-numbered selection periods (fN being even-numbered). In the third and fourth frames (FN=3, 4), the second scanning pattern set PB is used in odd-numbered selection periods (fN being odd-numbered), and the first scanning pattern set PA is used in even-numbered selection periods (fN being even-numbered). The first scanning patterns set PA and the second scanning pattern set PB are alternated on a basis of the period of polarity inversion of scanning electrode voltages because of the following reason. With regard to scanning pattern set of a scanning electrode group, it is preferable to alternate the first scanning pattern set PA and the second scanning pattern set PB in order to avoid fixation. If the first scanning pattern set PA and the second scanning pattern set PB are alternated within the period of polarity inversion of scanning electrode voltages, DC components of voltages applied to liquid crystal might not be fully cancelled. Accordingly, the first scanning pattern set PA and the second scanning pattern set PB are alternated on a basis of the period of polarity inversion of scanning electrode voltages.

Third, the sequence is determined so that scanning pattern will be continuous at the time of switching between selection periods. For example, in the first frame (FN=1), the third scanning pattern P3 is used both at the end of an odd-numbered selection period and at the beginning of an even-numbered selection period, and the fourth scanning pattern P4 is used both at the end of an even-numbered selection period and at the beginning of an odd-numbered selection period. Accordingly, the number of inversions of various signals is minimized, serving to reduce power consumption.

<Signal Electrode Driving Circuit>

Figure 11:
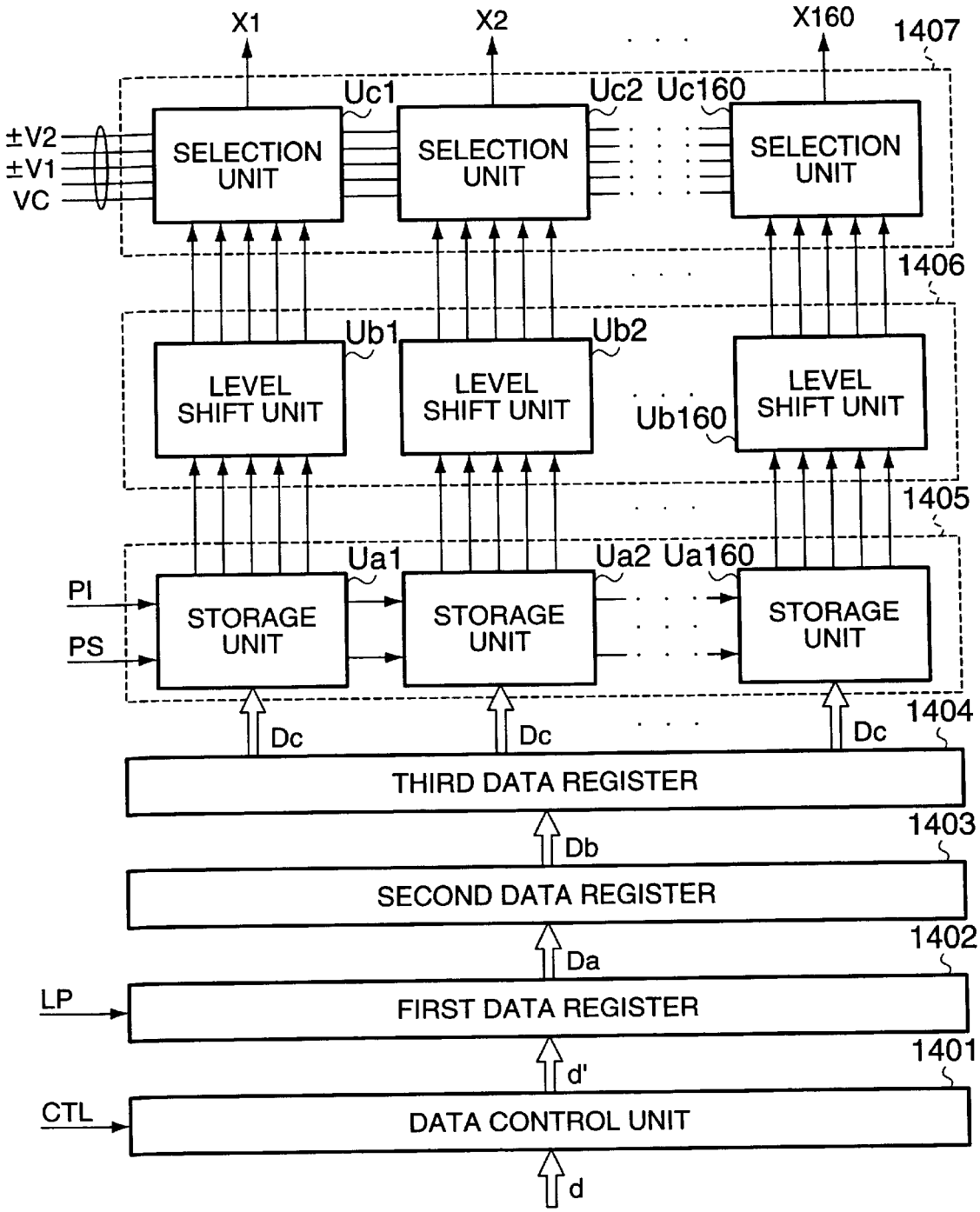
FIG. 11 is a schematic showing the construction of a signal electrode driving circuit 140.
Figure 12:
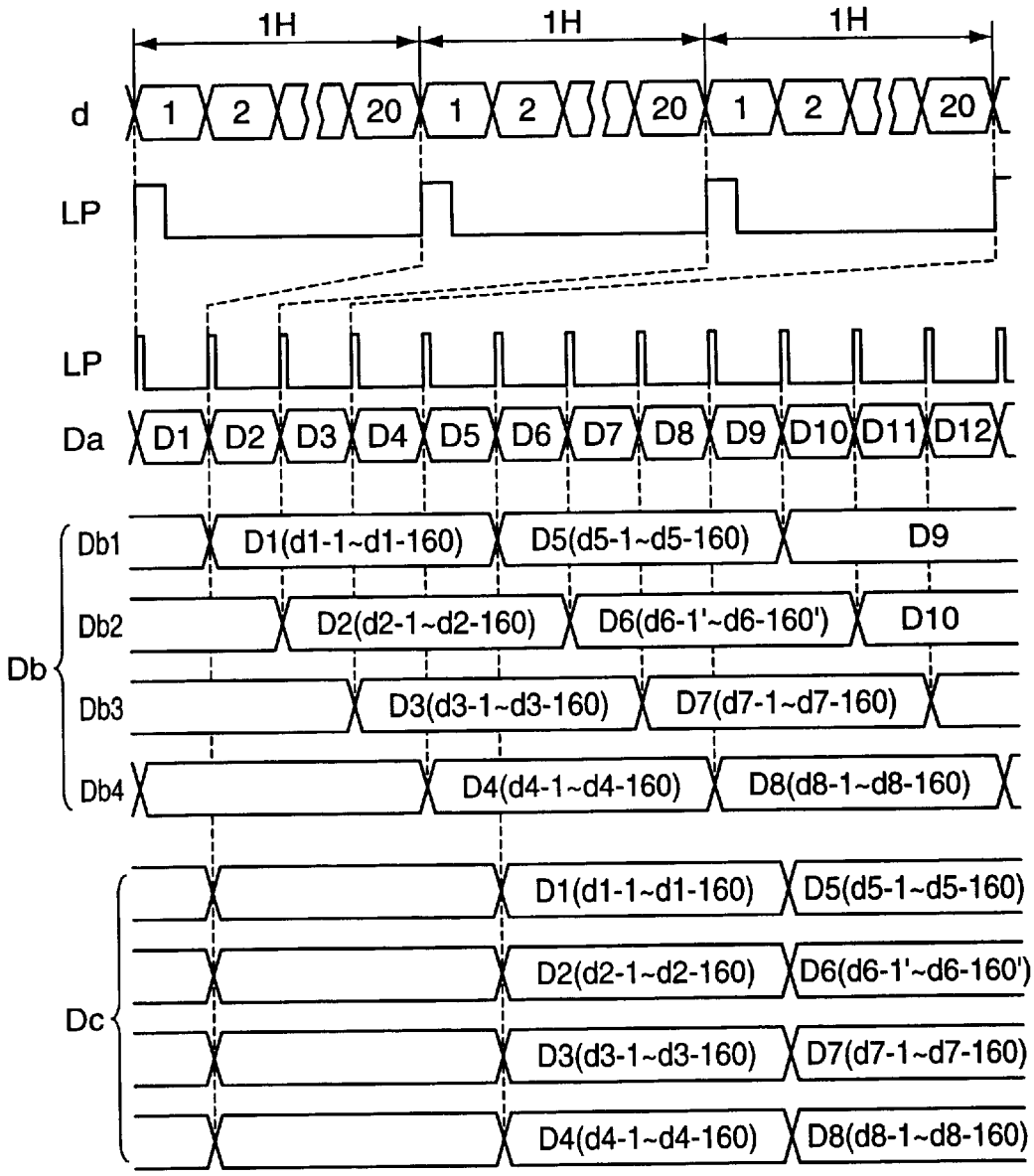
FIG. 12 is a timing chart showing waveforms at respective parts of the signal electrode driving circuit 140.

Next, the signal electrode driving circuit 140 will be described. FIG. 11 is a schematic showing the construction of the signal electrode driving circuit 140, and FIG. 12 is a timing chart showing waveforms at respective parts of the signal electrode driving circuit 140. Referring to FIG. 11, the signal electrode driving circuit 140 includes a data control unit 1401, first to third data registers 1402 to 1404, a storage circuit 1405, a level shifter 1406, and a selection circuit 1407.

The data control unit 1401 inverts display data d in each period when the inversion control signal CTL goes active, generating converted display data d'. The display data d and the converted display data d' are in eight-bit parallel format. Each bit of the display data d specifies whether to turn on or turn off a corresponding pixel for display. That is, a set of display data d specifies whether to turn on or turn off each of eight pixels. Since the number of signal electrodes is 160 in this embodiment, display status of pixels associated with a scanning electrode (one line) is specified by twenty sets of display data d.

The first data register 1402 has a storage capacity corresponding to one line. The first data register 1402 latches the converted display data d' based on the latch pulse LP, and converts it into data Da. The data Da is in 160-bit parallel format. In the following description, data associated with each pixel will be denoted as dy-x, y indicating the number of scanning electrode counted from the top, x indicating the number of signal electrode counted from the left.

Furthermore, inverted data will be denoted as dy-x'.

The second data register 1403 includes four registers. The four registers each have a storage capacity corresponding to one line, and respectively store data Da associated with the first to fourth scanning electrodes R1 to R4. The time axis of the data Da is thus expanded fourfold, whereby data Db shown in FIG. 12 is output from the second data register 1403. In FIG. 12, Db1, Db2, Db3, and Db4 indicate output data of the respective four registers.

The third data register 1404 includes 160 registers each having a storage capacity of four bits. The bits of each of the 160 registers correspond to the data Db1 to Db4. The third data register 1404 latches the data Db and outputs data Dc. Thus, the data Dc represents a display pattern in a particular selection period.

The storage circuit 1405 includes 160 storage units Ua1 to Ua160, and it specifies voltages to be applied to signal electrodes based on the number of mismatches between display pattern and scanning pattern.

The storage circuit 1405 stores selection data Ds corresponding to the first scanning pattern set PA, but does not store selection data Ds corresponding to the second scanning pattern set PB. Each storage unit Ua is associated with one signal electrode. Each of the storage units Ua1 to Ua160 stores the polarity inversion signal PI, display pattern, and scanning pattern in association with selection data Ds. In this embodiment, selection data Ds has five bits, and if one of the bits is "1," the other bits are "0." The selection data Ds determines voltages to be applied to a signal electrode. Display pattern is specified by the data Dc, and scanning pattern is specified by the scanning pattern control signal PS.

When the polarities of scanning electrode voltages are selected based on the second scanning pattern set PB, signal electrode voltages must also be selected based on the second scanning pattern set PB. In this embodiment, the storage circuit 1405 only stores selection data Ds corresponding to the first scanning pattern set PA. When the second scanning pattern set PB is used, however, display pattern reflects the converted display data d' having been inverted in the data control unit 1401. Thus, selection data Ds corresponding to the second scanning pattern set PB can be generated using the storage circuit 1405.

The level shifter 1406 includes 160 level shift units Ub1 to Ub160, and it converts small-am plitude selection data into large-amplitude selection control signals. Thus, circuits preceding the level shifter 1406 can be driven by a low power supply voltage. For example, it is possible to drive circuitry from the data control unit 1401 to the storage circuit 1405 by 3 V while driving circuitry subsequent to the level shifter 1406 by 10 V.

The selection circuit 1407 includes 160 selection units Uc1 to Uc160. Each of the selection units Uc1 to Uc160 selects a voltage from ±V2, ±V1, and VC according to the selection control signal. The selection units Uc1 to Uc160 apply selected voltages respectively to the signal electrodes X1 to X160 as signal electrode voltages.

<Scanning Electrode Driving Circuit>

Figure 13:
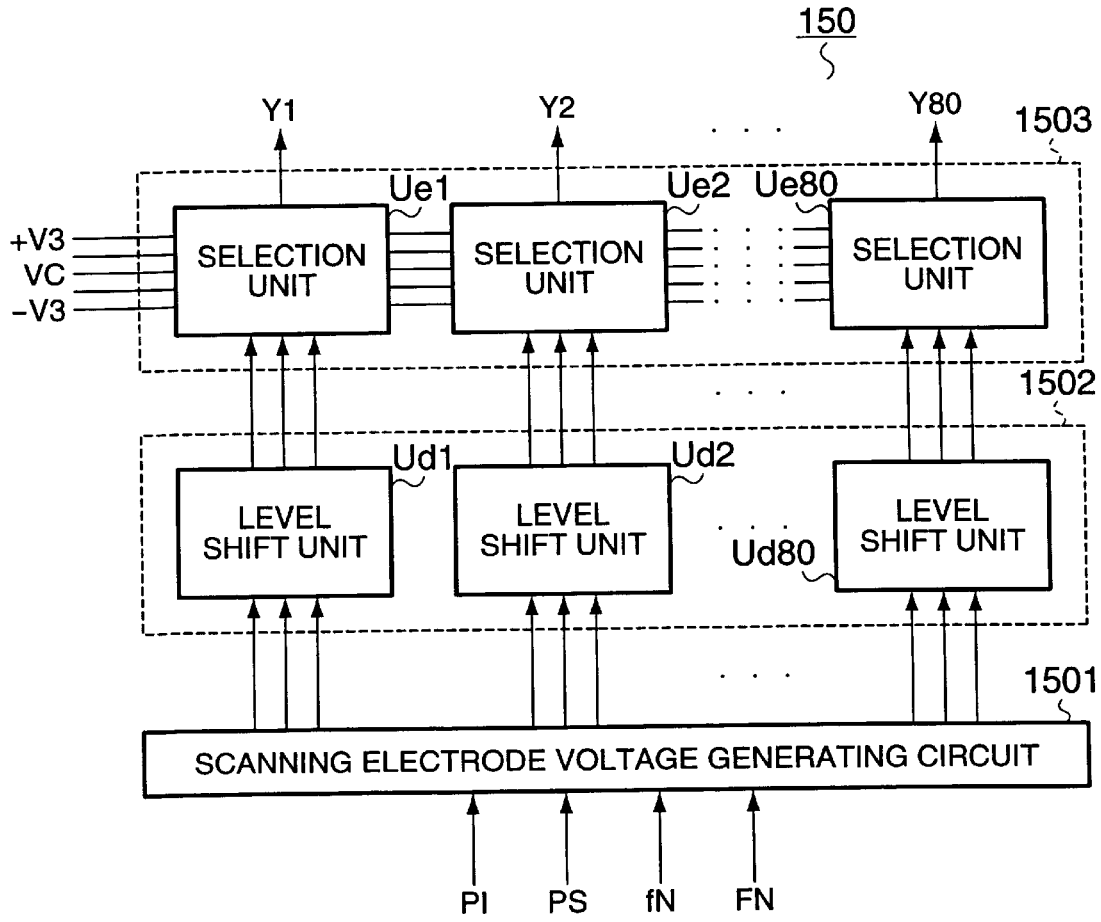
FIG. 13 is a schematic showing the construction of a scanning electrode driving circuit 150.

Next, the scanning electrode driving circuit 150 will be described. FIG. 13 is a schematic showing the construction of the scanning electrode driving circuit 150. Referring to FIG. 13, the scanning electrode driving circuit 150 includes a scanning electrode voltage generating circuit 1501, a level shifter 1502, and a selection circuit 1503.

The scanning electrode voltage generating circuit 1501 generates a scanning electrode voltage selection signal based on the polarity inversion signal PI, the scanning pattern control signal PS, and the scanning number signal fN. The scanning electrode voltage selection signal specifies voltages to be applied to the scanning electrodes according to the following rules.

First, the scanning electrode voltage selection signal executes control so that a scanning electrode group coinciding with a number indicated by the scanning number signal fN is selected and selection voltages ±V3 are applied to scanning electrodes belonging to the selected scanning electrode group while non-selection voltage VC is applied to scanning electrodes belonging to other scanning electrode groups.

Second, the scanning electrode voltage selection signal selects either the first scanning pattern set PA or the second scanning pattern set PB based on the frame number signal FN and the scanning number signal fN. Relationship of selection of scanning pattern set to frame number and scanning number is shown in FIG. 10.

Third, the scanning electrode voltage selection signal executes control so that positive selection voltage +V3 or negative selection voltage −V3 is applied to each of the first to fourth scanning electrodes R1 to R4 based on the scanning pattern control signal PS and the polarity inversion signal PI. The polarity of selection voltage is inverted when the polarity inversion signal PI is at high level (i.e., in even-numbered frames).

The level shifter 1502 includes 80 level shift units Ud1 to Ud80, and it shifts signal level of the scanning electrode voltage selection signal, supplying the result to the selection circuit 1503. The selection circuit 1503 includes 80 selection units Ue1 to Ue80. The selection units Ue1 to Ue80 each select a voltage from ±V3 and VC according to the scanning electrode voltage selection signal. The selected voltages are applied respectively to the scanning electrodes as scanning electrode voltages.

FIG. 14 are charts showing relationship of voltages applied to the first to fourth scanning electrodes R1 to R4 to scanning patterns, scanning pattern sets, scanning number signal fN, and frame number signal FN.

<Operation of Liquid Crystal Apparatus>

Figure 15:
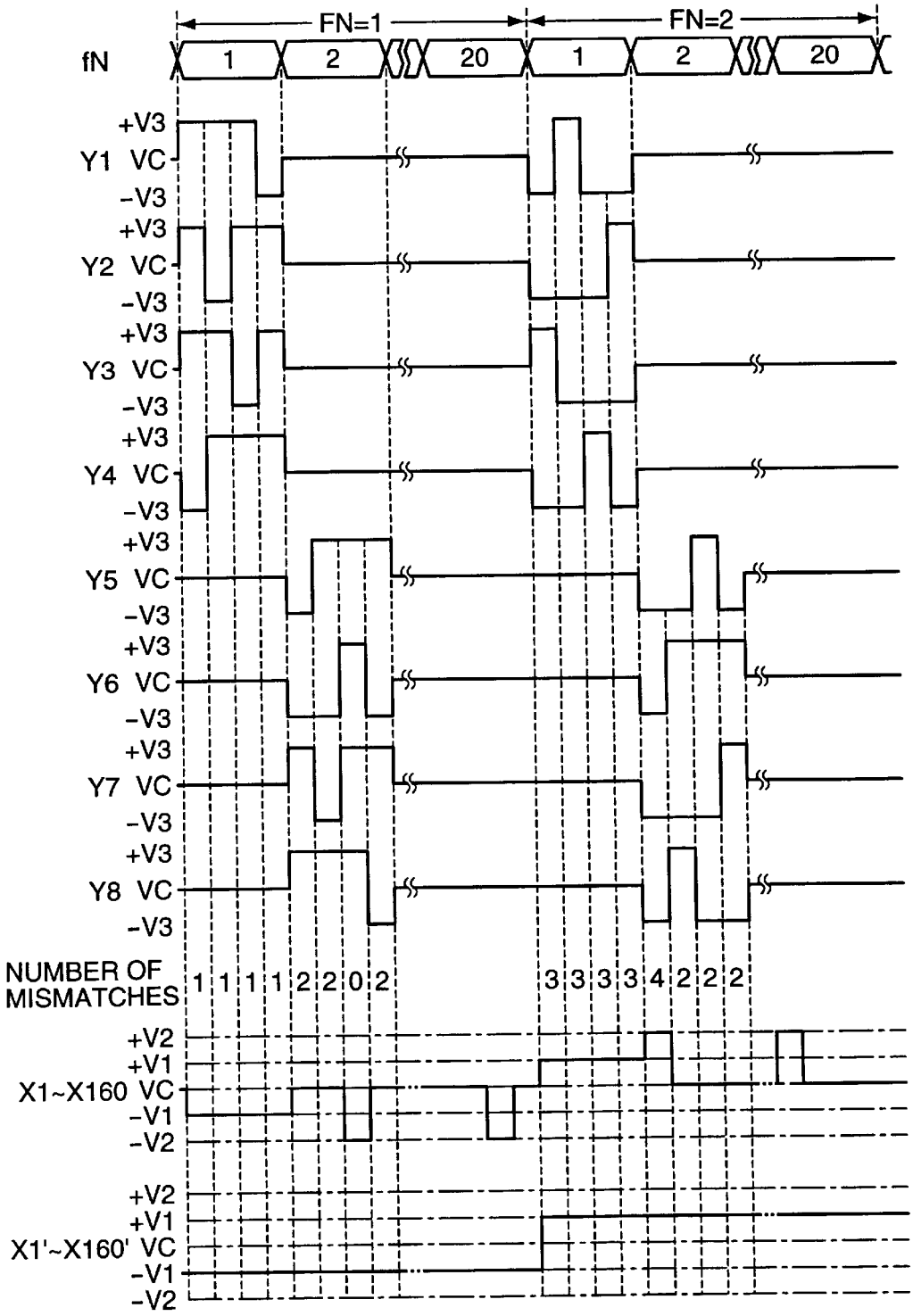
FIG. 15 is a timing chart showing relationship between voltage waveforms at scanning electrodes Y1 to Y8 and voltage waveforms at signal electrodes X1 to X160 in first and second frames.
Figure 16:
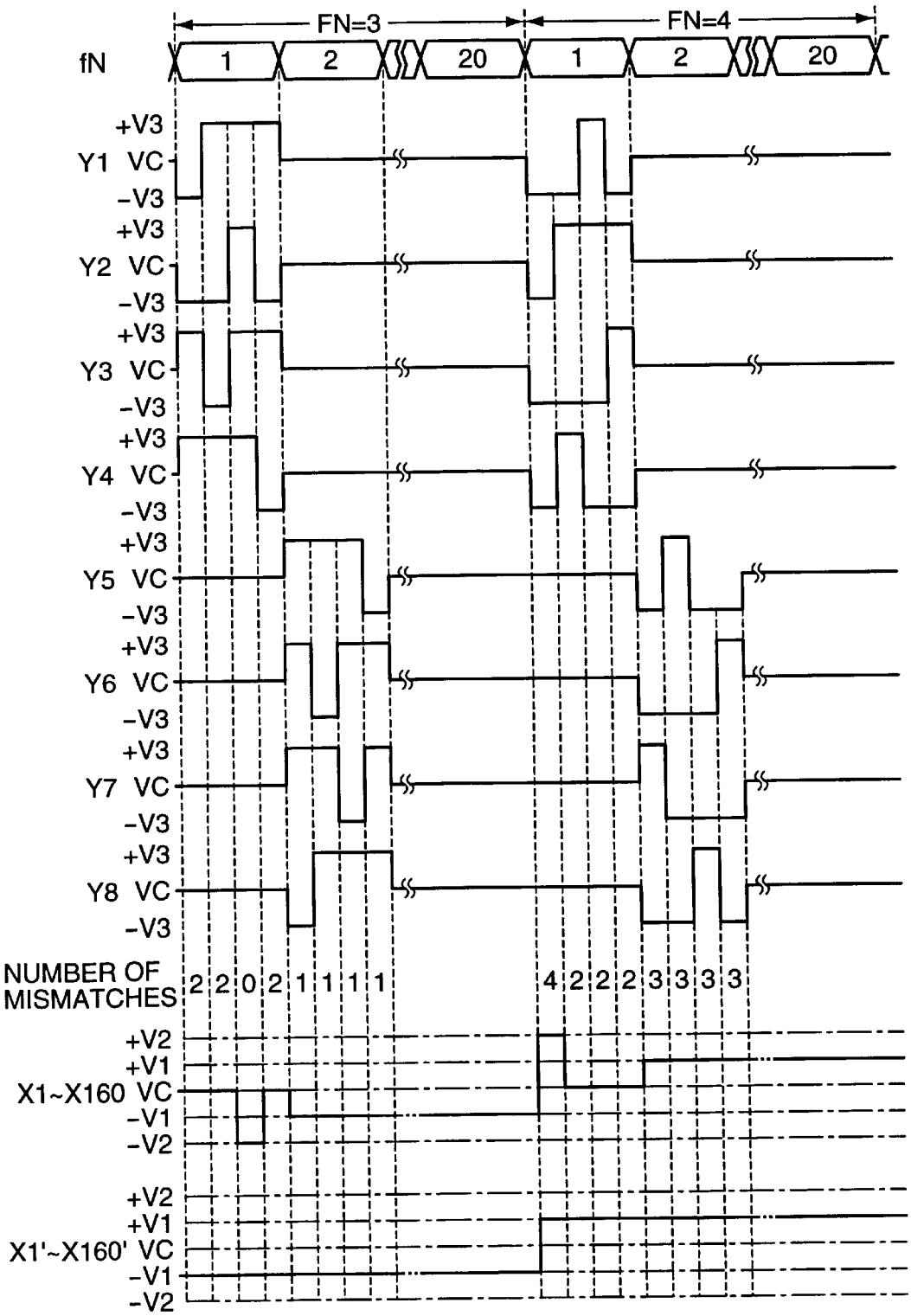
FIG. 16 is a timing chart showing relationship between voltage waveforms at scanning electrodes Y1 to Y8 and voltage waveforms at signal electrodes X1 to X160 in third and fourth frames.
Figure 21:
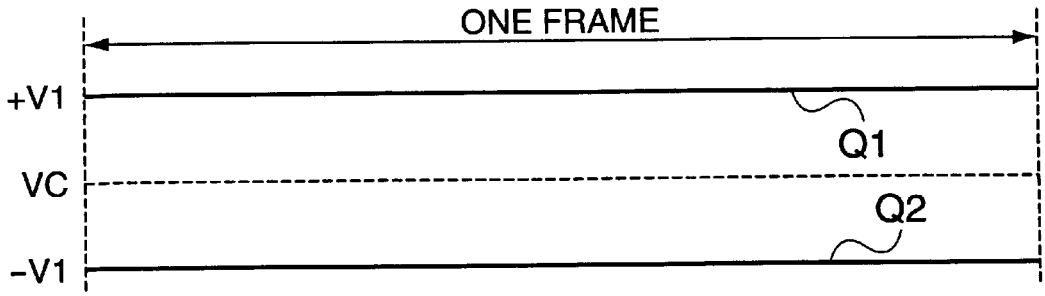
FIG. 21 is a waveform chart showing voltage waveforms at signal electrodes in the case where pixels on the signal electrodes are all turned off.
Figure 22:
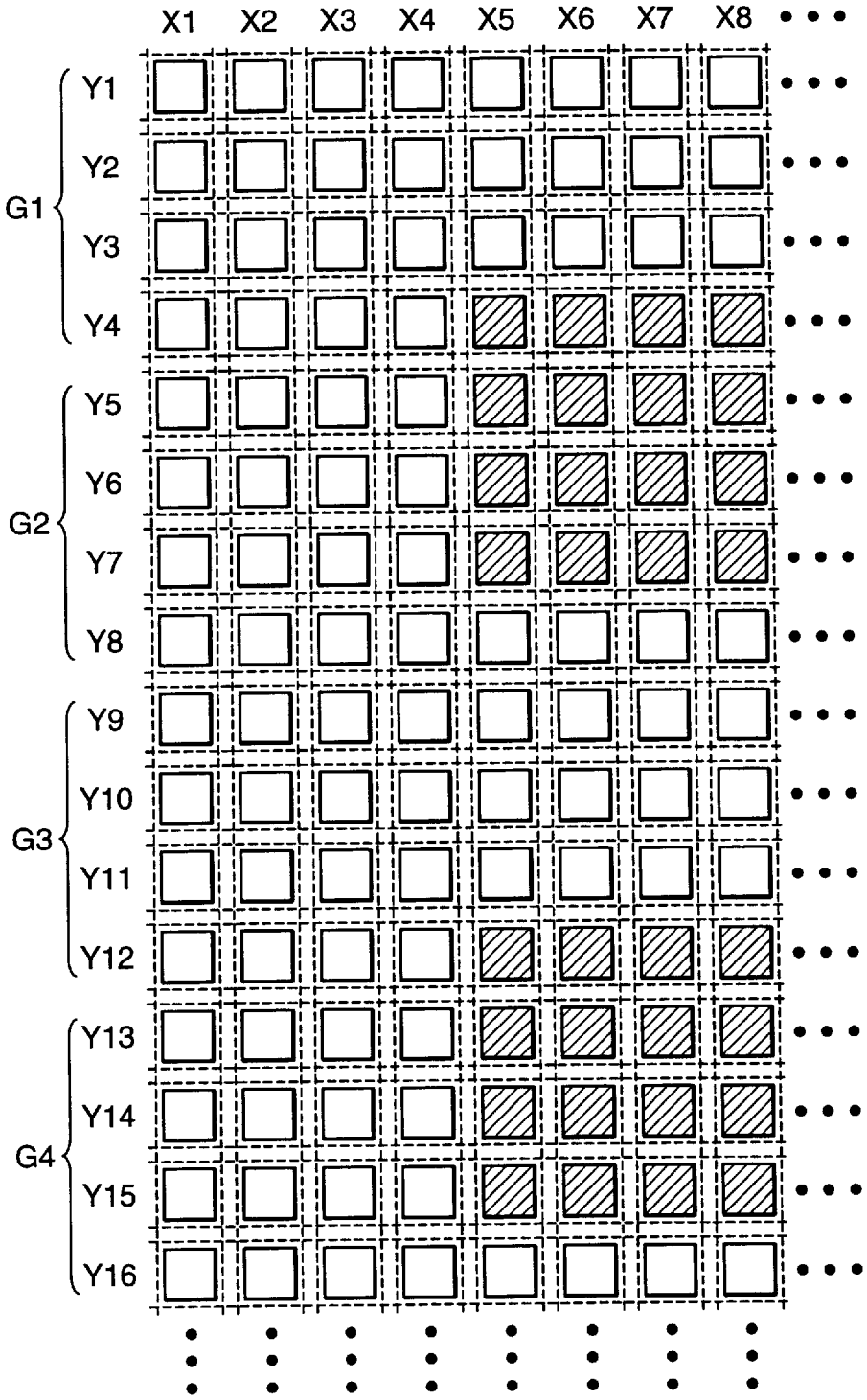
FIG. 22 is a schematic showing an example of display pattern.

Next, operation of the liquid crystal apparatus according to this embodiment will be described. FIG. 15 is a timing chart showing relationship between voltage waveforms at the scanning electrodes Y1 to Y8 and voltage waveforms at the signal electrodes X1 to X160 in the first and second frames. FIG. 16 is a timing chart showing relationship between voltage waveforms at the scanning electrodes Y1 to Y8 and voltage waveforms at the signal electrodes X1 to X160 in the third and fourth frames. In this example, every pixel is turned on (+1) for display. As a comparative example, voltage waveforms at the signal electrodes X1' to X160' in the case where only the first scanning pattern set PA is used are shown.

The scanning electrodes Y1 to Y4 and Y5 to Y8 correspond to the first to fourth scanning electrodes R1 to R4, respectively. Thus, voltages shown in FIGS. 15 and 16 are applied to the scanning electrodes Y1 to Y8 according to the relationship shown in FIG. 14. For example, in the first selection period (fN=1) in the first frame (FN=1), the scanning electrode group G1 is selected. The polarities of selection voltages applied to the scanning electrodes Y1 to Y4 in a period T1 are "+1, +1, +1, −1." Since display pattern is "+1, +1, +1, +1," the number of mismatches is "1." When the number of mismatches is "1," the signal electrode voltage is "−V1." Thus, "−V1" is applied to each of the signal electrodes X1 to X160, as shown in FIG. 15.

Then, in the second selection period (fN=2) in the first frame (FN=1), the scanning electrode group G2 is selected. The polarities of selection voltages applied to the scanning electrodes Y5 to Y8 in a period T2 are "−1, −1, +1, +1." Since display pattern is "+1, +1, +1, +1," the number of mismatches is "2." When the number of mismatches is "2," the signal electrode voltage is "VC." Thus, "VC" is applied to each of the signal electrodes X1 to X160, as shown in FIG. 15.

As shown in FIGS. 15 and 16, if only the first scanning pattern set PA is used, voltage waveforms at the signal electrodes X1' to X160' are either "−V1" or "+V1." In contrast, if both the first scanning pattern set PA and the second scanning pattern set PB are used, voltage waveforms at the signal electrodes X1 to X160 become more complex, so that bias in frequency components is removed.

As shown in FIG. 23, instead of the second scanning pattern set PB shown in FIG. 4, scanning pattern sets in which a pattern of a row or column is inverted or patterns are interchanged between rows or columns as compared with the second scanning pattern set PB, for example, a scanning pattern set PB1 that includes, instead of the scanning pattern P2, a scanning pattern that is the inverse of the scanning pattern P2, or a scanning pattern set PB2 in which the pattern for the second scanning electrodes R2 and the pattern for the third scanning electrodes R3 are interchanged, may be used.

Although the first scanning pattern set PA and the second scanning pattern set PB are alternately used in the embodiment described above, the present invention is not limited thereto, and the arrangement may be such that three or more scanning pattern sets are alternately used. Also in that case, it suffices for the storage circuit 1405 to store only selection data Ds corresponding to one scanning pattern set (referred to as a reference scanning pattern set). Then, the control circuit 120 determines which of the scanning pattern sets to use according to a predetermined rule, and generates the inversion control signal CTL based on mismatch between elements of the scanning pattern set thus determined and those of the reference scanning pattern set. Thus, the converted display data d' is reflected on display pattern that is used to access the storage circuit 1405.

<Cellular Phone>

Next, an example where the liquid crystal apparatus described above is applied to a cellular phone will be described. FIG. 17 is a perspective view showing the construction of the cellular phone. Referring to FIG. 17, the cellular phone 1300 includes a plurality of operation buttons 1302, an earpiece 1304, a mouthpiece 1306, and the liquid crystal panel 100 described above. The liquid crystal panel 100 achieves display without unevenness in luminance.

Electronic apparatuses to which the display apparatus according to the above embodiment can be suitably applied include, for example, pagers, timepieces, PDAs (Personal Digital Assistants) as well as cellular phones described above, for example.

Furthermore, application is also possible to liquid crystal television sets, video tape recorders of view-finder or monitor-direct-viewing type, car navigation apparatuses, electronic calculators, word processors, workstations, videophones, POS terminals, and apparatuses with touch panels, etc., for example.

[Advantages]

As described above, according to the present invention, a plurality of scanning pattern sets are alternately used, so that bias in frequency components of signal electrode voltages is removed. Furthermore, a plurality of scanning pattern sets are alternately used in a simple construction.

What is claimed is:

1. A method of driving an electro-optical apparatus constructed such that a plurality of scanning electrodes and a plurality of signal electrodes are disposed so as to hold an electro-optical material therebetween and to cross each other, in which the plurality of scanning electrodes are divided into a plurality of scanning electrode groups that each have a predetermined number of scanning electrodes, the method comprising:

selecting a scanning electrode group a plurality of times in each frame;

applying a positive selection voltage or a negative selection voltage with reference to a reference voltage at a center potential to each of the scanning electrodes belonging to the scanning electrode group during the selection period according to a scanning pattern set including a plurality of predetermined scanning patterns;

comparing a display pattern that specifies whether to turn on or turn off a plurality of pixels associated with intersections on the scanning electrodes belonging to the scanning electrode group with the scanning pattern;

applying voltages selected from a plurality of predetermined voltages respectively to the signal electrodes based on the number of mismatches between elements of the display pattern and elements of the scanning pattern;

alternately using a first and a second scanning pattern sets on a basis of a predetermined period to apply voltages respectively to the scanning electrodes and applying voltages respectively to the signal electrodes; and providing the first scanning pattern set such that elements associated with a scanning electrode are inverted in the second scanning pattern set.

2. The method of driving an electro-optical apparatus according to claim 1, further including applying the first scanning pattern set to some of the scanning electrode groups, and applying the second scanning pattern set to the other scanning electrode groups.

3. The method of driving an electro-optical apparatus according to claim 2, further including providing electro-optical material that is liquid crystal, alternately applying voltages of a polarity indicated by the scanning pattern and voltages of a polarity opposite to the polarity indicated by the scanning pattern on a basis of a predetermined period of inversion, and alternately the first scanning pattern set and the second scanning pattern set on a basis of each period of the inversion of polarity.

4. The method of driving an electro-optical apparatus according to claim 3, further including providing the period of inversion as two frames, in a two-frame period, applying the first scanning pattern set to a first scanning electrode group of a pair of adjacent scanning electrode groups, and applying the second scanning pattern set to a second scanning electrode group thereof, and in a next two-frame period, applying the second scanning pattern set to the first scanning electrode group of the pair of adjacent scanning electrode groups, and applying the first scanning pattern set to the second scanning electrode group.

5. The method of driving an electro-optical apparatus according to claim 1, further including storing a relationship of each of the scanning patterns belonging to the second scanning pattern set and the display pattern to voltages to be applied to the signal electrodes in advance, when the first scanning pattern set is applied, inverting display data associated with scanning electrodes associated with inverted elements in the second scanning pattern set, generating the display pattern based on the inverted display data, and determining voltages to be applied to the signal electrodes based on the generated display pattern and the scanning patterns and with reference to stored content.

6. A driving circuit to drive an electro-optical apparatus constructed such that a plurality of scanning electrodes and a plurality of signal electrodes are disposed so as to hold an electro-optical material therebetween and to cross each other, the plurality of scanning electrodes being divided into a plurality of scanning electrode groups that each have a predetermined number of scanning electrodes, the driving circuit comprising:

a device that selects a scanning electrode group a plurality of times in each frame;

a device that applies a positive selection voltage or a negative selection voltage with reference to a reference voltage at a center potential to each of the scanning electrodes belonging to the scanning electrode group during the selection period according to a scanning pattern set including a plurality of predetermined scanning patterns;

a device that compares a display pattern that specifies whether to turn on or turn off a plurality of pixels associated with intersections on the scanning electrodes belonging to the scanning electrode group with the scanning pattern;

a device that applies voltages selected from a plurality of predetermined voltages respectively to the signal electrodes based on the number of mismatches between elements of the display pattern and elements of the scanning pattern;

a storage device that stores scanning patterns constituting a reference scanning pattern set that is one of a plurality of scanning pattern sets, and a display pattern, in association with selection data to select voltages to be applied to the signal electrodes;

a scanning pattern control device that generates a scanning pattern control signal to select one of the scanning patterns according to a predetermined rule;

a data control device that determines which scanning pattern set to use and to invert display data based on mismatch between elements in the scanning pattern set determined and elements in the reference scanning pattern set;

a display pattern generating device that generates a display pattern based on output data from the data control unit; and a signal electrode voltage application device that applies voltages to signal electrodes according to selection data read from the storage device based on the display pattern generated by the display pattern generating device and the scanning pattern control signal.

7. The driving circuit according to claim 6, further comprising a scanning electrode voltage application device that applies voltages to the scanning electrodes based on the scanning pattern control signal.

8. The driving circuit according to claim 6, the number of the plurality of scanning pattern sets being two, the scanning pattern set other than the reference scanning pattern set being such that elements associated with a scanning electrode are inverted in the reference scanning pattern set, and the data control device inverting display data associated with the scanning electrode for output when the scanning pattern set other than the reference scanning pattern set is used.

9. An electronic apparatus, comprising:

an electro-optical panel constructed such that a plurality of scanning electrodes and a plurality of signal electrodes are disposed so as to hold an electro-optical material therebetween and to cross each other; and a driving circuit to drive the electro-optical panel, in which the plurality of scanning electrodes are divided into a plurality of scanning electrode groups that each have a predetermined number of scanning electrodes, a scanning electrode group is selected a plurality of times in each frame, a positive selection voltage or a negative selection voltage with reference to a reference voltage at a center potential is applied to each of the scanning electrodes belonging to the scanning electrode group during the selection period according to a scanning pattern set including a plurality of predetermined scanning patterns, a display pattern that specifies whether to turn on or turn off a plurality of pixels associated with intersections on the scanning electrodes belonging to the scanning electrode group is compared with the scanning pattern, and voltages selected from a plurality of predetermined voltages are applied respectively to the signal electrodes based on the number of mismatches between elements of the display pattern and elements of the scanning pattern, the driving circuit including:

a storage device that stores scanning patterns constituting a reference scanning pattern set that is one of a plurality of scanning pattern sets, and a display pattern, in association with selection data to select voltages to be applied to the signal electrodes;

a scanning pattern control device that generates a scanning pattern control signal to select one of the scanning patterns according to a predetermined rule;

a data control device that determines which scanning pattern set to use and to invert display data based on mismatch between elements in the scanning pattern set determined and elements in the reference scanning pattern set;

a display pattern generating device that generates a display pattern based on output data from the data control unit; and a signal electrode voltage application device that applies voltages to signal electrodes according to selection data read from the storage device based on the display pattern generated by the display pattern generating device and the scanning pattern control signal.

10. The method of driving an electro-optical material, in which four of a plurality of scanning electrodes to select a plurality of electro-optical materials are simultaneously selected and a signal voltage defining intensity levels of display by the plurality of electro-optical materials are applied to signal electrodes in each of four fields within one frame, the method of driving an electro-optical material comprising:

a first step of applying either a first voltage or a second voltage of the same magnitude and a different polarity with respect to the first voltage to the signal electrodes as the signal voltage; and a second step of applying one of a third voltage of a different magnitude with respect to the first and second voltages, a fourth voltage of the same magnitude and a different polarity with respect to the third voltage, and a center voltage between the third and fourth voltages, to the signal electrodes as the signal voltage.

11. The method of driving an electro-optical material according to claim 10, further including alternately executing the first step and the second step on a basis of each field.

12. A driving circuit to drive an electro-optical material, in which four of a plurality of scanning electrodes to select a plurality of electro-optical materials are simultaneously selected and a signal voltage defining intensity levels of display by the plurality of electro-optical materials are applied to signal electrodes in each of four fields within one frame, the driving circuit comprising:

a device to apply either a first voltage or a second voltage of the same magnitude and a different polarity with respect to the first voltage to the signal electrodes as the signal voltage; and a device to apply one of a third voltage of a different magnitude with respect to the first and second voltages, a fourth voltage of the same magnitude and a different polarity with respect to the third voltage, and a center voltage between the third and fourth voltages, to the signal electrodes as the signal voltage.

13. The driving circuit to drive an electro-optical material according to claim 12, application of either the first voltage or the second voltage and application of one of the third voltage, the fourth voltage, and the center voltage being alternately executed on a basis of each field.

14. A display apparatus, comprising:

the driving circuit to drive an electro-optical material according to claim 12.

* * * * *